US006879799B2

(12) United States Patent
Nohsho et al.

(10) Patent No.: US 6,879,799 B2
(45) Date of Patent: Apr. 12, 2005

(54) IMAGE-FORMING APPARATUS AND IMAGE-FORMING PROCESS-CARTRIDGE

(75) Inventors: Shinji Nohsho, Shizuoka (JP); Hiroshi Nagame, Shizuoka (JP); Hidetoshi Kami, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/384,701

(22) Filed: Mar. 11, 2003

(65) Prior Publication Data

US 2003/0219279 A1 Nov. 27, 2003

(30) Foreign Application Priority Data

Mar. 13, 2002 (JP) ..... 2002-068550

(51) Int. Cl.[7] ..... G03G 15/09; G03G 15/00; G03G 15/08; G03G 15/04; G03G 9/00

(52) U.S. Cl. ..... 399/267; 399/159; 399/252; 430/66; 430/111.32

(58) Field of Search ..... 399/111, 159, 399/161, 162, 252, 259, 267, 302; 430/56, 66, 67, 111.1, 111.3, 111.32, 111.35

(56) References Cited

U.S. PATENT DOCUMENTS 4,409,309 A * 10/1983 Oka ..... 430/66 X
5,781,835 A * 7/1998 Okano et al. ..... 399/267 X
5,871,876 A 2/1999 Ikuno et al.
5,991,573 A 11/1999 Nohsho et al.
6,014,532 A 1/2000 Takeichi et al.
6,030,733 A 2/2000 Kami et al.
6,060,205 A 5/2000 Takeichi et al.
6,118,964 A 9/2000 Kojima et al.
6,151,468 A 11/2000 Kami et al.
6,160,977 A 12/2000 Takeichi et al.
6,326,112 B1 12/2001 Tamura et al.
6,363,237 B1 3/2002 Nagame et al.
6,432,596 B2 8/2002 Ikuno et al.
6,438,343 B1 * 8/2002 Inoue ..... 399/302 X
6,444,387 B2 9/2002 Ri et al.
6,492,079 B2 12/2002 Shimada et al.
6,516,169 B2 2/2003 Niimi et al.
6,521,386 B1 2/2003 Sakon et al.

FOREIGN PATENT DOCUMENTS

JP 2001-188388 * 7/2001

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image-forming apparatus which includes an image developer configured to develop a latent electrostatic image and to have a developer, a developer bearing member which has a magnet therein, has the developer on a surface thereof, and rotates with carrying the developer, and a developer limiting member which faces the developer bearing member, and controls an amount of the developer, and a latent electrostatic image support configured to contain a filler in its outermost layer. In the image-forming apparatus, the developer is a double-component developer which contains a magnetic carrier and a toner, the magnetic carrier has a coating layer which is formed of a binder resin having particles retained on a surface of the magnetic carrier, and a ratio of a particle diameter D1 of the particles to a film thickness h1 of the binder resin satisfies a relation of: $1<D1/h1<10$.

16 Claims, 6 Drawing Sheets

IMAGE-FORMING APPARATUS AND IMAGE-FORMING PROCESS-CARTRIDGE

BACKGROUND OF THE INVENTION

1. Field of the Invention

The present invention relates to an image-forming apparatus, and more specifically to an image-forming apparatus such as an electrophotographic apparatus using a dry double-component developer.

2. Description of the Related Art

Conventionally, for an image-forming apparatus, a development process using a double-component developer which comprises magnetic carriers and toners has been employed, in which a magnetic brush is formed of the double-component developer. An image-forming apparatus that employs the development process with a double-component developer contains a rotatably supported cylindrical development sleeve as a developer carrier, which comprises a magnetic roller having a magnet body with a plurality of pairs of magnetic poles. In the image-forming apparatus, the cylindrical development sleeve further has toners adhered to carriers on its surface, and the toners are transferred to a development area, in which developing is carried out.

A development process using a one-component developer has also been employed, in which the one-component developer consists of either magnetic toners or non-magnetic toners. In the development process using a one-component developer, an image-forming apparatus has different structures and means for charging toners from the development process with a double-component developer. In both of the processes, however, developing is carried out by having toners on a surface of a development sleeve, and then by transferring the toners to a development area.

Japanese Patent Application Publication (JP-B) No. 64-12386 discloses a method of improving a quality of an image by roughening a surface of a development sleeve so as to transfer toners in an improved state. As described in Japanese Patent Application Laid-Open (JP-A) No. 05-19632, a surface of a development sleeve is roughened so as to transfer toners in an improved state, in a development process using a double-component developer.

In the aforementioned methods, developing is carried out by a non-contacting developing method. The non-contacting developing method is a method to determine a certain amount of a developer to be transferred onto a developer bearing member, by using a developer limiting member. A contacting (impression) developing method requires a developer limiting member made of rigid or rigid and magnetic materials. The contacting developing method therefore has a difficulty in supplying a sufficient amount of developer onto a developer bearing member. Carriers are also required to have a smaller particle diameter, in accordance with an increasing demand for a high-quality and miniaturized apparatus. The smaller diameter a carrier has, the poorer the fluid ability of the carrier is. A developer having carriers with a smaller diameter hence has a difficulty in stably transferring into a development area.

For the purpose of economizing and reducing the cost of maintenance services, image-forming devices such as a copier is usually constructed in one-piece structure in which a photoconductor (latent electrostatic image support) and a developing device are attached. The image-forming device allows a service person to easily replace the photoconductor and the developing device. In this case, a photoconductor and a developing device should be replaced at a long interval, otherwise the cost increases. A developer having a long lifetime, and a photoconductor having almost the same lifetime as the photoconductor are necessary. In the contacting developing method employing a double-component developer, a photoconductor is abraded by the developer. The developer is unlikely to have a longer lifetime, accordingly. A demand has also been made on widening a density for supplying a developer in order to obtain a higher quality of image. The higher the density for supplying a developer is, the more a photoconductor is abraded. Filler is added to a protecting layer of a photoconductor, so as to prevent abrasion on the photoconductor. Abrasion is certainly prevented, however, resolution deteriorates, and a blurred image is more likely to be produced, because of substances such as ozone, nitrogen oxide, a nitric acid ionic substance, ammonium ionic substances, and the like, all of which are cumulated on a surface of the photoconductor, and induce a blurred image.

SUMMARY OF THE INVENTION

It is therefore an object of the present invention to prevent ozone, a nitrogen oxide, a nitric acid ionic substance, an ammonium ionic substance, and the like, from cumulating on a surface of a photoconductor, by contacting a developer with the surface of the photoconductor, with a suitable force. Another object of the present invention is to prevent producing a blurred image caused by the aforementioned substances. Another object of the present invention is to stabilize a quality of image of an image-forming apparatus, and to improve the reliability of the image-forming apparatus, by giving a longer lifetime to a latent electrostatic image support.

The inventors of the present invention have carefully examined and studied the materials and structure of magnetic carrier coating layer, materials contained in developers, and the materials and structure of the outermost layer of the latent electrostatic image support which is the photoconductor. As a result, it was found out that giving a certain formation to a magnetic carrier coating layer and an outermost layer of a latent electrostatic image support would considerably reduce the amount of ozone, a nitrogen oxide, a nitric acid ionic substance, an ammonium ionic substance, and the like, which are cumulated on an outerlayer of a photoconductor, would prevent a latent electrostatic image support from deteriorating, and would also prevent causing a blurred image.

The present invention provides, in a first aspect, an image-forming apparatus comprises an image developer configured to develop a latent electrostatic image and to have a developer, a developer bearing member which has a magnet therein, has the developer on a surface thereof, and rotates with carrying the developer, and a developer limiting member which faces the developer bearing member, and controls an amount of the developer, and a latent electrostatic image support configured to contain a filler in an outermost layer thereof. In the image-forming apparatus of the present invention, the developer is a double-component developer which contains a magnetic carrier and a toner, the magnetic carrier has a coating layer which is formed of a binder resin having particles retained on a surface of the magnetic carrier, and a ratio of a particle diameter D1 of the particles to a film thickness h1 of the binder resin satisfies a relation of: $1<D1/h1<10$.

DESCRIPTION OF THE PREFERRED EMBODIMENTS

The image-forming apparatus of the present invention employs a developing process with a double-component developer. The image-forming apparatus includes an image developer configured to have a developer bearing member which has a magnet therein, has the developer on a surface thereof, and rotates with carrying the developer, and a developer limiting member which faces the developer bearing member, and controls an amount of the developer.

The present invention proposes the following mechanisms (1) and (2), which significantly reduce the amount of adhered substances such as ozone, nitrogen oxide, nitric acid ionic substances, ammonium ionic substances, and the like, on an outermost layer of a latent electrostatic image support having filler.

(1) Taking advantage of the shape and configuration, a magnetic carrier having rather irregular surface scrapes the adhered substances on a surface of a latent electrostatic image support.

(2) Relatively fine particles in the coating layer of the magnetic carrier and fillers on an outermost layer of a latent electrostatic image support, are covered with a resin component at the initial stage. The relatively fine particles and the fillers are gradually exposed from the resin coat, as repeatedly used in an image-forming apparatus. Particles on the magnetic carriers directly contact with filler on the outermost layer of the latent electrostatic image support. As a result, adhered substances such as ozone, a nitrogen oxide, a nitric acid ionic substance, an ammonium ionic substance, and the like on fillers on the outermost layer of the latent electrostatic image support, are displaced to particles in a carrier coating layer, and the surface layer of the latent electrostatic image support is hence cleared.

(Image Developer)

The image developer used in the present invention will now be described. The term, "image developer," herein refers to a developing device that enables developing a latent electrostatic image with a developer.

Figure 1:
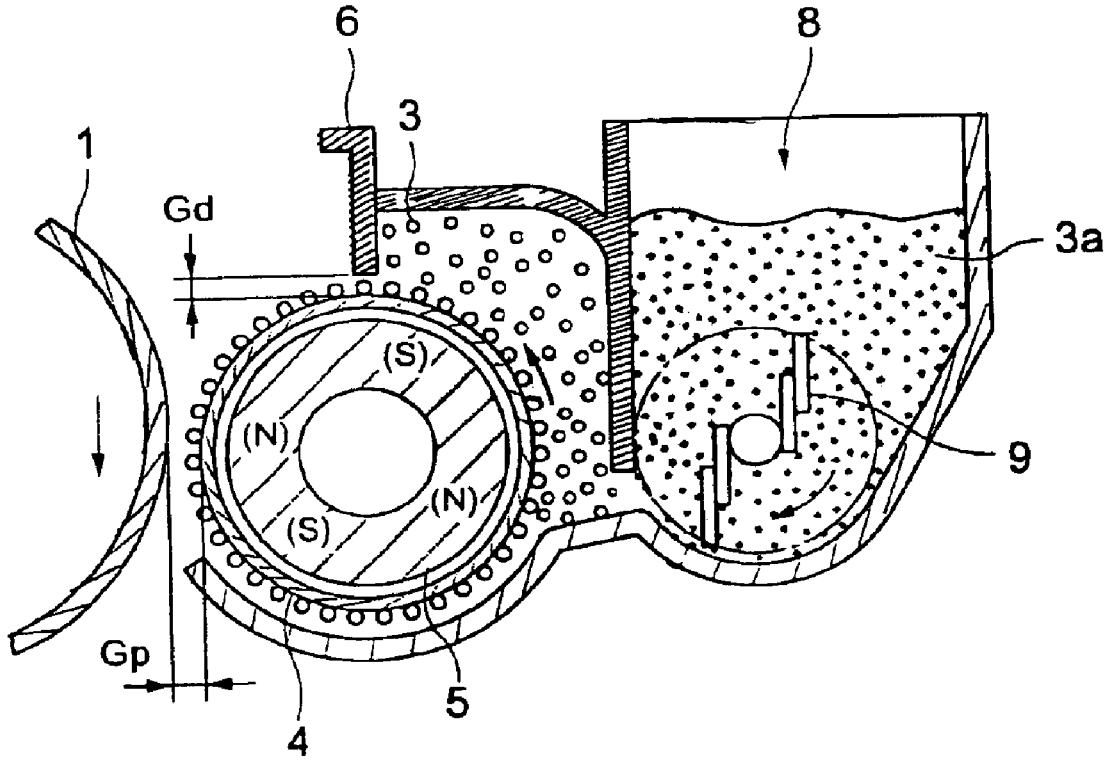
FIG. 1 is a sectional view showing one example of an image developer utilized in the image-forming apparatus of the present invention.

FIG. 1 is a schematic sectional view showing an example of the image developer of the present invention.

Referring into FIG. 1, an electro photographic photoconductor drum (a latent electrostatic image support) 1 rotates in the direction of the arrow, and has a protecting layer (outermost layer) containing filler on a surface of the electro photographic photoconductor drum 1. A latent electrostatic image is formed on the surface by a charger and light-irradiator, both of which are not shown in the figure, however. A development sleeve 4 is a developer bearing member. A magnetic roller 5 has plural pairs of N and S poles fixed inside the development sleeve 4 in a circumferential direction. This development sleeve 4 and the magnetic roller 5 carry a developer. The development sleeve 4 rotates in the same direction as that of the photoconductor drum 1 relative to the magnetic roller 5 which is mixed, so as to transfer the developer. The N and S poles of the magnetic roller 5 have a suitable magnetic flux. The magnetic roller provides a suitable magnetism, so as to form a magnetic brush formed of a developer. A developer limiting member 6 determines a height an a size of the magnetic brush, and is made of rigid or rigid and magnetic materials (the gap between the developer limiting member and the development sleeve will be referred to as a doctor gap Gd).

A toner is supplied to the toner hopper 8 in the interior of the image developer. The mixture 3*a* of the introduced toner and the magnetic carrier is thoroughly stirred and mixed by a supply roller 9 which rotates in the direction of the arrow, charged by friction, and thus the toner is attached to the surface of the magnetic carrier with friction force. The developer 3 consisting of the magnetic carrier and the toner attached to the surface of the carrier, is transported to the development sleeve 4. The distance between the surfaces of the development sleeve 4 and photoconductor drum 1 is set to a predetermined interval Gp (for example, 0.7 mm). In a case of developing the latent electrostatic image on the photoconductor drum 1 with the predetermined interval, the magnetic brushes formed on the surface of development sleeve 4 vibrates due to the density changes of magnetic flux, and is rotated and moves along with the development sleeve 4. The magnetic brushes then smoothly pass the predetermined interval in the development region, so as to form a latent electrostatic image with toners. During this time, a bias voltage may be applied between the development sleeve 4 and photoconductor drum 1 so as to facilitate developing.

(Double-Component Developer)

The term, "developer," herein refers to any kinds of agent used for developing a latent electrostatic image.

-Magnetic Carrier-

The magnetic carrier of the present invention which is coated with the binder resin supporting the particles, will now be described.

The magnetic carrier of the present invention has a coating layer, which is a film formed by a binder resin containing particles finer than the particles of the magnetic carrier. The refreshing of the surface of the latent electrostatic image support containing a filler is particularly marked when the ratio of the diameter D1 of these particles to the binder resin film thickness h1, satisfies the relation of $1<D1/h1<10$. This is because a portion where particles exist becomes convex towards a binder resin as a coating film. More adhered substances on a surface of the latent electrostatic image support are scraped, accordingly.

If D1/h1 is 1 or less, the particles become bedded in the binder resin. Therefore, far fewer adhered substances are scraped, which is not preferred. If D1/h1 is 10 or more, fewer particles are held on the surface of the magnetic carriers. Therefore, the particles on the magnetic carriers are separated from the surface of the magnetic carriers, which is not preferred, either.

A content of the particles on a surface of the magnetic carrier towards the components of a coating layer is 50% by weight to 90% by weight, and is more preferably 70% by weight to 90% by weight, so as to scrape the adhered substances.

Furthermore, when the particles are one type selected from alumina, silica, titania and zinc oxide, in particular when the particles are alumina, more adhered substances are scraped. If the content of the particles in the coating layer is less than 50% by weight, fewer particles are contained on a surface of the magnetic carriers towards the binder resin on the surface. Therefore, the particles are unable to fully absorb a strong impact to the binder resin, when contacted with a latent electrostatic image support. The magnetic carriers have insufficient durability. If the content is more than 95% by weight, an excessive amount of particles are contained on a surface of the magnetic carriers. Therefore, the binder resin, where charging takes place, is contained with an insufficient amount. The charging does not show sufficient charging properties. Additionally, the particles are more likely to be separated from a surface of the magnetic carriers, hence the magnetic carriers do not exhibit sufficient durability.

The thickness of the resin on the coating layer is preferably 0.001 μm to 20 μm, and more preferably 0.001 μm to 1 μm. The particle diameter of the particles retained by the coating layer is preferably 0.01 μm to 20 μm, and more preferably 0.05 μm to 5 μm. The particles having a particle diameter of 0.05 μm to 5 μm are coated with a resin layer having thickness of 1/1 to 1/10 with respect of the particle diameter, and then by retaining the particles on the magnetic carrier, the fine particles on the magnetic carrier are better retained, and their physical scraping force is also increased. In this case, the fine particles are retained even if the resin layer on the particles peels off. As the particles on the magnetic carrier contact the particles on the latent electrostatic image support, adhered substances that cause blurred images are smoothly transferred from the latent electrostatic image support.

The binder resin forming the coating layer of the magnetic carrier may be any of the resins known in the art. Of those, guanamine resins, acrylic resins and mixtures thereof, are preferred from the viewpoint that those resins are able to absorb impact, and to prolong the life of the carriers. Methods for coating the resin on the surface of the carriers include impregnation, a fluid-bed method, spraying, and the like.

From the viewpoint of preventing carrier deposition (scattering) onto the latent electrostatic image support, a core material of the magnetic carrier has at least an average particle diameter of 20 μm. From the viewpoint of preventing a quality of image from deteriorating, for example, the appearance of carrier lines, or the like, the average particle diameter needs to be 80 μm at maximum. If the average particle diameter is smaller than 20 μm, a carrier tends to be disposed onto the latent electrostatic image support, which is undesirable. If the average particle diameter is larger than 80 μm there is no particular disadvantage, but it is undesirable as an image with higher quality is required. Specific examples of the core material can be suitably selected from any known carriers of double-component developers for electrophotography, depending on the application and purpose of the carrier. The specific examples include ferrite, magnetite, iron, nickel, and the like. There is no particular limitation on the manufacturing method thereof.

-Toner-

The toners of the developer used together with magnetic carriers in the image-forming apparatus of the present invention may be manufactured by any known methods in the art. Specifically, it may be obtained by melt-kneading a mixture of the binder resin, colorant and a polar controlling agent with a heat roll mill. Thereafter, the mixture is cooled and solidified, and the mixture is then milled and classified. The mixture consists of the components such as a binder resin, a colorant, a charge controlling agent, and other additives, if necessary, described below.

All types of the binder resin known in the art may be used as the binder resin of the toners of the present invention. Examples are homopolymers of styrene and its substituents such as polyethylene, poly-p-styrene, polyvinyl toluene, and the like, styrene copolymers such as styrene-p-chloro styrene copolymer, styrene-propylene copolymer, styrene-vinyltoluene copolymer, styrene-methyl acrylate polymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-α-chlormethyl methacrylate copolymer, styrene-acrylonitrile copolymer, styrene-vinylmethylether copolymer, styrene-vinyl methyl ketone copolymer, styrene-butadiene copolymer, styrene-isoprene copolymer, styrene-maleic acid copolymer, styrene-maleic acid ester copolymer, and the like; polymethyl methacrylate, polybutylmethacrylate, polyvinyl chloride, polyvinyl acetate, polyethylene, polypropylene, polyester, polyurethane, polyamide, epoxy resin, polyvinylbutyral, polyacrylic acid, rosin, modified rosin, terpene resin, phenolic resin, aliphatic hydrocarbon resin, aromatic petroleum resin, chlorinated paraffin, paraffin wax, and the like. These may be used either alone or in combination of two or more.

The charge controlling agent used in the toner may be any of those known in the art. The examples of the charge controlling agent include metal complexes of mono-azo dyes; nitrohumic acid and salts thereof; metal complexes amino compounds having Co, Cr, Fe, and the like, of salicyclic acid, naphthoic acid, dicarboxylic acids, and the like; quaternary ammonium compounds; organic dyes; and the like. The amount of the polar controlling agent used for the toners is determined by types of binder resin, by the presence or absence of additives to be used if necessary, and by a method for manufacturing the toners including a method for dispersing the toners. There is no limitation on the amount of the polar controlling agent. The preferable amount is 0.1 parts by weight to 20 parts by weight towards 100 parts by weight of the binder resin. If the amount is less than 0.1 parts by weight, the charging amount of toners is insufficient, which is not practical. If the amount is more than 20 parts by weight, the toners are excessively charged, which causes lower fluidability of a developer, and a lower image density, due to the fact that more toners are latently attracted by carriers.

Examples of black colorants which may be contained in the toners include carbon black, aniline black, furnace black, lamp black, and the like. Examples of cyan colorants include phthalocyanine blue, methylene blue, Victoria blue, methyl violet, aniline blue ultramarine blue, and the like. Examples of magenta colorants include rhodamine 6G lake, dimethylquinacridone, watching red, rose Bengal, rhodamine B, alizarin lake, and the like. Examples of yellow colorants include chrome yellow, benzidine yellow, Hansa yellow, naphthol yellow, molybden olein, quinoline yellow, tartrazine, and the like.

A magnetic material may also be added to the toner, and the toner may be used as a magnetic toner. Examples of the magnetic materials contained in the magnetic toner include metal oxides such as magnetite, hematite, ferrite, and the like; metals such as iron, cobalt, nickel, and the like; alloys and mixtures of those metals and metals such as aluminium, cobalt, copper, lead, magnesium, tin, zinc, antimony, beryllium, bismuth, cadmium, calcium, manganese, selenium, titanium, tungsten, vanadium, and the like. It is preferred that these ferromagnetic materials have an average particle diameter of around 0.1 μm to 2 μm. The amount of the magetic materials to be contained in the toner is approximately 20 parts by weight to 200 parts by weight relative to 100 parts by weight of the binder resin component, and particularly preferred that it is 40 parts by weight to 150 parts by weight relative to 100 parts by weight of the binder resin component.

Examples of additives to be added to the toner include inorganic fine powders such as cerium oxide, silicon oxide, titanium oxide, silicon carbide, and the like. Of these, colloidal silica is particularly preferred.

-Charge and Resistance Controlling Agents-

Examples of the agent which controls the charge and adjusts resistance of the double-component developer include carbon black, and an acid catalyst. Those may be used either alone or in combination. The carbon black may be any type generally used for carriers or toners. The acid catalyst may be any substance having a catalytic action. The acid catalyst may, for example, have reactive groups such as complete alkylation, methyloyl, imino or methyloyl/imino groups. The examples of the acid catalyst are not limited.

The amount of carriers and toners to be used is obtained by mixing the carriers and the toners, so that the toner particles adhere a surface of the carriers, in order that the adhered toner particles account for 30% to 90% of a surface of the carriers.

(Latent Electrostatic Image Support)

Figure 2:
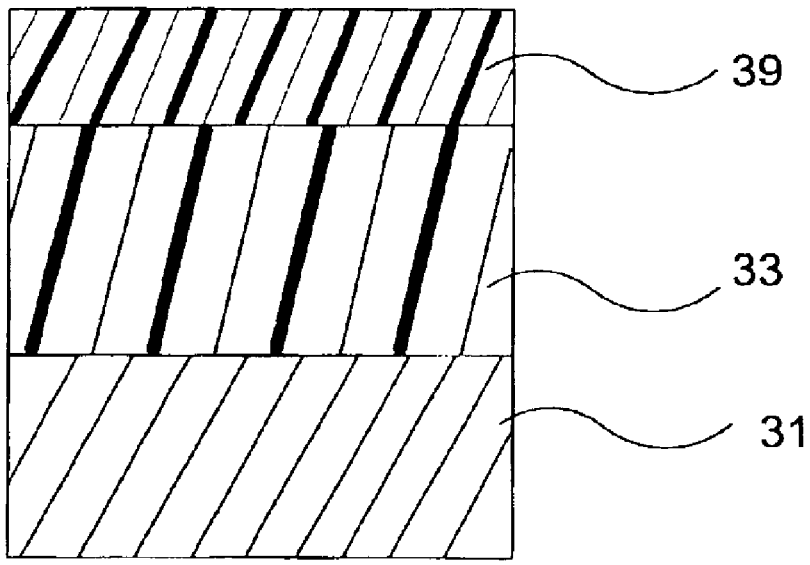
FIG. 2 is a sectional view showing one example of the layer structure of a latent electrostatic image support utilized in the image-forming apparatus of the present invention.
Figure 3:
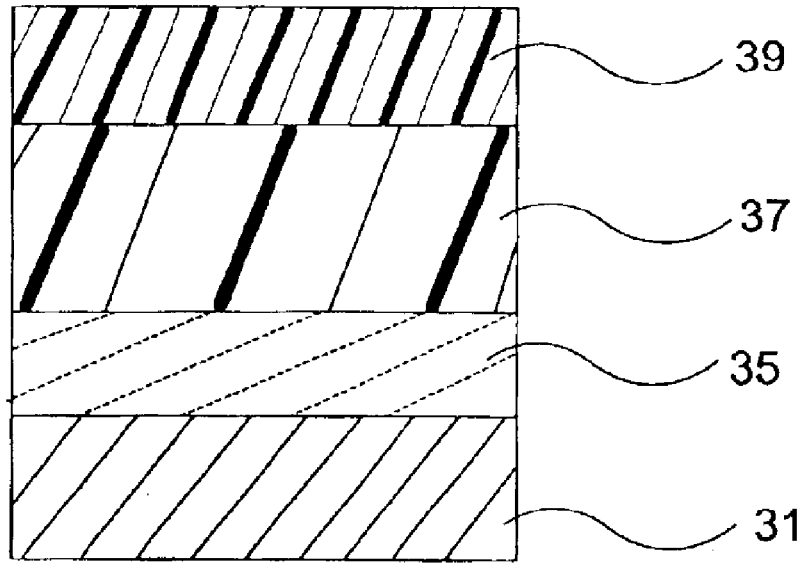
FIG. 3 is a sectional view showing another example of the layer structure of the latent electrostatic image support utilized in the image-forming apparatus of the present invention.
Figure 4:
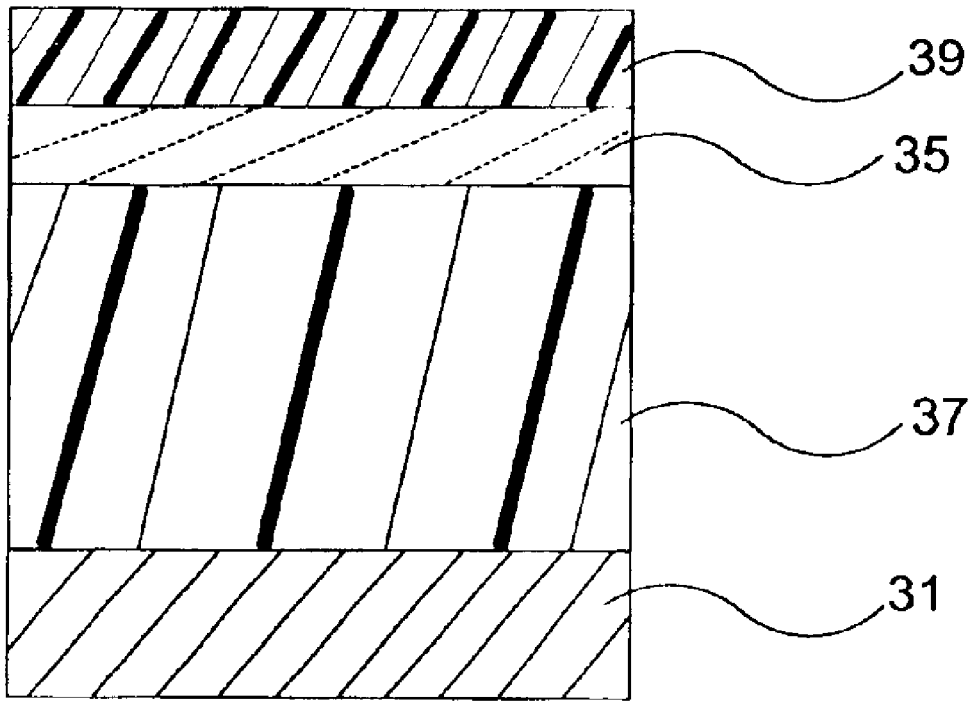
FIG. 4 is a sectional view showing another example of a layer structure of the latent electrostatic image support utilized in the image-forming apparatus of the present invention.

Referring to FIGS. 2 to 4, the structure of a latent electrostatic image support according to the present invention will be described hereinafter. A latent electrostatic image support according to the present invention has a laminated structure which includes at least two layers.

The laminated structure is characterized by the outermost layer of the latent electrostatic image support. Hereinafter, the latent electrostatic image support of the present invention, where a surface of the protecting layer is coated on the photoconductive layer so as to form an outermost layer (a surface protecting layer=an outermost layer=a protect layer), will be described.

FIG. 2 is a sectional view showing one example of the latent electrostatic image support used in the present invention. A single layer-photoconductive layer 33 having a charge generating material and a charge transporting material as the main components, is provided on an electroconducting support 31. A protecting layer 39 is provided on the single layer-photoconductive layer 33.

FIG. 3 is a sectional view showing an example of another structure of the latent electrostatic image support used in the present invention. The photoconductive layer has a laminated structure comprising a charge generating layer 35 having a charge generating material as its main component, and a charge transporting layer 37 having a charge transport material as its main component, a protecting layer 39 which is provided on the charge transporting layer 37.

FIG. 4 is a sectional view showing an example of yet another structure of the latent electrostatic image support used in the present invention. The photoconductive layer has a laminated structure comprising the charge transporting layer 37 having a charge transport material as its main component, and the charge generating layer 35 having a charge generating material as its main component, the protecting layer 39 which is provided on the charge generating layer 35.

In the latent electrostatic image supports shown in FIGS. 2 to 4, the protecting layer 39 is provided on a single layer or laminated layer to protect the photoconductive layer. Examples of materials used for the protecting layer are ABS resin, ACS resin, olefin-vinyl monomer copolymer, polyether chloride, allyl resin, phenolic resin, polyacetal, polyamide, polyamide imide, polyacrylate, polyallylsulfone, polybutylene, polybutylene terephthalate, polyimide, acrylic resin, polymethyl pentene, polypropylene, polyphenylene oxide, polysulfone, AS resin, butadiene-styrene copolymer, polyurethane, polyvinyl chloride, polyvinylidene chloride, epoxy resin, and the like.

It is also preferred that the protecting layer, which is the outermost layer, further comprises a fluorine resin such as poly tetrafluoroethylene or silicone resins in order to improve wear-resistance, and these resins or the aforesaid protecting layer material must contain an inorganic filler such as titanium oxide, tin oxide, potassium titanate or silica, or an organic filler. Of these fillers, metal oxides are preferred, in particular one or more of alumina, titania, silica and tin oxide.

To reduce residual potential, improve photosensitivity and obtain high speed response of the protecting layer 39, it is preferred to add a charge transport material. The added charge transport material is a low molecular weight charge transport material mentioned in the description of the charge transporting layer 37, described hereinafter. A charge transport material having high molecular weight, described hereinafter, can also be used to improve wear resistance and achieve high speed response.

The protecting layer is formed by ordinary coating methods. The thickness of the protecting layer is suitably of the order of 2 μm to 30 μm from the viewpoint of durability. The essential feature of the present invention is the relation between the outermost layer (here, the protecting layer) film thickness of the latent electrostatic image support and the filler particle diameter. Specifically, it is desirable that the ratio of the outermost layer film thickness h2 to a filler diameter D2 lies within the range $3<D2/h2<100$. By adopting this range, there are no traces of filler on the surface of the latent electrostatic image support, and a flat or (relatively etc) flat outermost layer is obtained. If h2/D2 is less than 3, the particle diameter of the filler is too large for the outermost layer, there are irregularities where traces of filler remain on the outermost layer surface, and these interfere with the removal of spotting materials and substances adhering to the exposed filler by the carrier which holds fine particles on its surface. Further, as regards the light reaching the photoconductive layer, the light used for image exposure is absorbed or scattered by the filler, which is undesirable. If h2/D2 is 100 or more, it means that the filler particle diameter is extremely small if the thickness of the protecting layer is limited, and that improvement of wear-resistance, which is the actual purpose of the protecting layer, can no longer be expected. Considering that the thickness of the protecting layer is limited, if the number of filler particles is largely increased, spotting materials and substances tend to adhere to the active filler, and the number of adherence points (the area or portion where materials or substances are adhered) also increases, which is undesirable.

The particle diameter of the filler contained in the outermost layer of the latent electrostatic image support may lie within a range of 0.02 μm to 33 μm. It is possible to satisfy the above ratio with the film thickness over this whole range, but in practice 0.3 μm to 1.0 μm is suitable.

The filler content in the outermost layer of the latent electrostatic image support is 5% by weight to 60% by weight. If the filler content is less than 5% by weight, the filler content in the outermost layer is insufficient, and the improvement of wear-resistance cannot be expected. If it is more than 60% by weight, the excessive amount of fillers causes problems with the electrical properties of the latent electrostatic image support. Therefore, the image is likely to have toner deposition on a background thereof, and the image density is also likely to decrease.

Examples of the materials for the electroconductive support 31 include those having a volume resistance of $10^{10}$ Ω·cm or less. More specifically, the materials may be prepared by coating the metals or the metal oxides on a film-shaped or a cylindrical-shaped piece of plastic or paper with vapor deposition or sputtering. Alternatively, plates comprising aluminium, aluminium alloy, nickel or stainless steel can be used, or tubes made from raw pipe by extrusion or drawing, cutting, and surface treatment by superfinishing or polishing. The endless nickel belt and endless stainless steel belt disclosed in Japanese Patent Application Laid-Open (JP-A) No. 52-36016, may also be used as the electroconducting support 31.

In addition to the aforesaid electroconductive support, the examples of the electroconductive support 31 further include a product made by dispersing an electroconductive powder in a suitable binder resin and coating it on the support. Examples of this electroconductive powder are carbon black, acetylene black, metal powders of aluminium, nickel, iron, nichrome, copper, zinc or silver, or metal oxide powders such as electroconductive tin oxide and ITO. The binder resin of the electroconductive support used along with the electroconductive powder may be a thermoplastic resin, thermoset resin or photo-curing resin such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, acetyl cellulose resin, ethyl cellulose resin, polyvinylbutyral, polyvinyl formal, poly-N-vinylcarbazole, acrylic resin, silicone resin, epoxy resin, melamine resin, urethane resin, phenolic resin, alkyde resin, and the like. The electroconductive layer may be formed by dispersing these electroconductive powders and the binder resin in a suitable solvent such as tetrahydrofuran, dichloromethane, methyl ethyl ketone or toluene, and by applying the solution.

The examples of the electroconductive support 31 of the present invention further include those having the electroconductive layer formed of a heat-contraction tube on a suitable cylindrical support. The heat-contraction tube contains the electroconducting powder and materials such as polyvinyl chloride, polypropylene, polyester, polystyrene, polyvinylidene chloride, polyethylene, chlorinated rubber, Teflon (a registered trademark), and the like.

Next, the photoconductive layer formed on the aforesaid electroconducting support will be described, hereinafter. The photoconductive layer may be a single layer (FIG. 2) or a multilayer (FIG. 3 or 4). For convenience, the case of a multilayer comprising the charge generating layer 35 and charge transporting layer 37, will first be described.

The charge generating layer 35 is a layer comprising mainly a charge generating substance, and it may also comprise a binder resin, if necessary. The charge generating substance may be an inorganic material or an organic material.

Examples of the inorganic charge generating substances include crystalline selenium, amorphous selenium, selenium-tellurium, selenium-tellurium-halogen, selenium-arsenide, amorphous-silicon, and the like. Suitable examples of the amorphous-silicon include those terminating hydrogen atoms or halogen atoms with dangling bonds, or doping boron atoms or phosphorus atoms.

Organic charge generating substances may be any of those known in the art. Examples of the organic charge generating substances include phthalocyanine pigments such as metal phthalocyanine, non-metal phthalocyanine, and the like; azulenium salt pigments, squaralic acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquine or polycyclic quinone pigments, quinone imine pigments, diphenyl methane and triphenyl methane pigments, benzoquinone and naphthoquinone pigments, cyanine and azomethine pigments, indigoid pigments, bis-benzimidazole pigments, and the like. These charge generating substances can be used either alone or in combination of two or more.

Examples of the binder resin which may be used as the charge generating layer 35 if necessary include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinylbenzal, polyester, phenoxy resin, vinyl chloride-vinyl acetate copolymer, polyvinylacetate, polyphenylene oxide, polyvinylpyridine, cellulose resin, casein, polyvinyl alcohol, polyvinyl pyrrolidone, and the like. The amount of the binder resin is 0 part by weight to 500 parts by weight, and preferably 10 parts by weight to 300 parts by weight, relative to 100 parts by weight of the charge generating substance.

Methods for forming the charge generating layer 35 may be broadly classified into a vacuum thin film forming method and a casting method of dispersing a solution. The film thickness of the charge generating layer 35 is suitably between 0.01 μm to 5 μm, and more preferably between 0.1 μm to 2 μm.

Examples of the vacuum thin film forming method include vacuum vapor deposition, glow discharge decomposition, ion plating, sputtering, reactive sputtering, the CVD method, and the like. It is possible to form a layer of the aforementioned inorganic material or organic material as the charge generating layer 35.

To provide the charge generating layer by the casting method, the inorganic or organic charge generating substance is dispersed, if necessary, together with the binder resin, into a solvent by a ball mill, Attritor or sand mill. Examples of the solvent include tetrahydrofuran, cyclohexanone, dioxane, dichloroethane, butanone, and the like. The charge generating layer 35 is formed by suitably diluting the dispersion, and then by coating the dispersion. The coating may be performed by immersion coating, or by a method such as spray coating, bead coat nozzle coating, spinner coating; ring coating, or the like.

The charge transporting layer 37 for the latent electrostatic image support used in the present invention may be formed by dissolving or dispersing the charge transport material and binder resin in a suitable solvent, and then by coating and drying. If necessary, a plasticizer, levelling agent or antioxidant may also be added to the solvent.

The charge transport substance contained in the charge transporting layer 37 may be an electron hole transport material or an electron transport material. Examples of the electron transport materials include electron accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b] thiophene-4-one, 1,3,7-trinitrodibenzothiophene-5,5-dioxide, benzoquinone derivatives, and the like.

Examples of the electron hole transport materials include poly-N-vinylcarbazole and derivatives thereof, poly-y-carbazolylethylglutamate and derivatives thereof, pyrene-formaldehyde condensation products and derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, enamine derivatives, any other materials known in the art, and the like. These charge transport materials may be used either alone or in combination of two or more.

Examples of the binder resin used in the charge transporting layer 37 include thermoplastic resins or thermoset resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarate, phenoxy resin, poly carbonate, acetyl cellulose resin, ethyl cellulose resin, polyvinylbutyral, polyvinyl formal, polyvinyl toluene, poly-N-vinyl carbazole, acrylic resin, silicone resin, epoxy resin, melamine resin, urethane resin, phenolic resin, alkyde resin, and the like.

The content of charge transport material is suitably 20 parts by weight to 300 parts by weight, and preferably 40 parts by weight to 150 parts by weight relative to 100 parts by weight of the binder resin. The film thickness of the charge transporting layer is preferably 5 μm to 100 μm. Examples of the solvents which can be used include tetrahydrofuran, dioxane, toluene, dichloromethane, monochlorobenzene, dichloroethane, cyclohexanone, methylethylketone, acetone, and the like.

Examples of the materials for the charge transporting layer 37 may also include charge transport polymeric compound which functions both as the charge transport material and as the binder resin. A charge transporting layer comprising the charge transport polymeric compounds are excellent in film-forming since the material itself is a polymer, and is able to realize a higher density of charge transport regions than a charge transporting layer comprising a low molecular weight dispersion type polymer. As a result, a high speed response can be expected for the latent electrostatic image support comprising the charge transporting layer that has the charge transport polymeric compound. Examples of the charge transport polymeric compound may include any of those known in the art, and preferably a polycarbonate comprising a triarylamine structure in a main chain and/or a side chain. Of these, the charge transport polymeric compounds represented by the following Formulae 1 to 12 may be used.

Formula 1 is shown below.

Formula 1

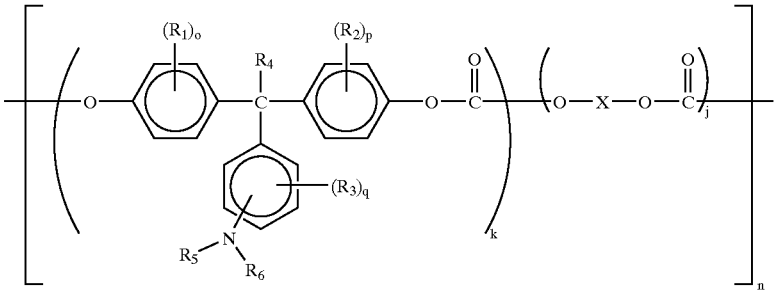

In the Formula 1, $R_1$ to $R_3$ are each substituted or non-substituted alkyl groups or halogen atoms, $R_4$ is a hydrogen atom, or a substituted or non-substituted alkyl group, and $R_5$ and $R_6$ are each substituted or non-substituted aryl groups. "o," "p," and "q" are each integers from 0 to 4. "k," and "j" are each a composition, and each satisfy the relations of: $0.1 \leqq k \leqq 1$, and $0 \leqq j \leqq 0.9$; "n" is the number of repeating unit, and is an integer of 5 to 5000. "X" is a bivalent aliphatic group, a bivalent cyclic aliphatic group, or a bivalent group represented by the following Formula 2.

Formula 2

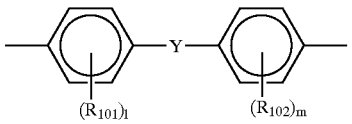

In the Formula 2, $R_{101}$ and $R_{102}$ are each a substituted or non-substituted alkyl group, aryl group or a halogen atom. $R_{101}$ and $R_{102}$ may be either identical or different, if there is a plurality of groups or halogen atoms. "l," and "m" are each an integer of 0 to 4. "Y" is a single bond, linear, branched or cyclic alkylene group having 1–12 carbon atoms, or groups expressed by as follow. "Y" may also be —O—, —S—, —SO—, —$SO_2$—, —CO—, —CO—O-Z-O—CO—, in which "Z" is a bifunctional aliphatic group having 1 to 12 of carbon atoms.

Formula 3

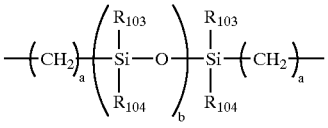

(in the Formula 3, "a" is an integer of 1 to 20, "b" is an integer of 1 to 2000, $R_{103}$ and $R_{104}$ are each a substituted or non-substituted alkyl group or aryl group. $R_{103}$ and $R_{104}$ may be identical or different).

Formula 4 is shown below.

Formula 4

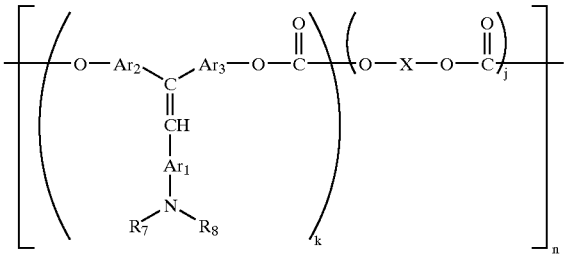

In the Formula 4, $R_7$ and $R_8$ are each a substituted or non-substituted aryl group. $Ar_1$ to $Ar_3$ are an identical or different allylene group. "X," "k," "j," and "n" are identical to those of Formula 1.

Formula 5 is shown below.

Formula 5

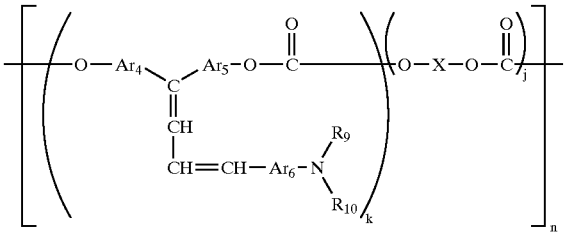

In the Formula 5, $R_9$ and $R_{10}$ are each a substituted or non-substituted aryl group. $Ar_4$ to $Ar_6$ are each an identical or different allylene group. "X," "k," "j," and "n" are identical to those of Formula 1.

Formula 6 is shown below.

Formula 6

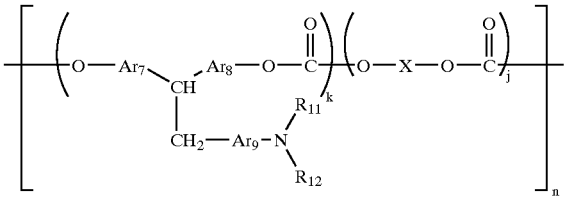

In the Formula 6, $R_{11}$ and $R_{12}$ are each a substituted or non-substituted aryl group. $Ar_7$ to $Ar_9$ are each an identical or different allylene group, and "p" is an integer of 1 to 5. "X," "k," "j," and "n" are identical to those of Formula 1.

Formula 7 is shown below.

In the Formula 7, $R_{13}$ and $R_{14}$ are each a substituted or non-substituted aryl group. $Ar_{10}$ to $Ar_{12}$ are each an identical or different allylene group. $X_1$ and $X_2$ are each a substituted or non-substituted ethylene group, or a substituted or non-substituted vinylene groups. "X," "k," "j," and "n" are identical to those of Formula 1.

Formula 8 is shown below.

Formula 8

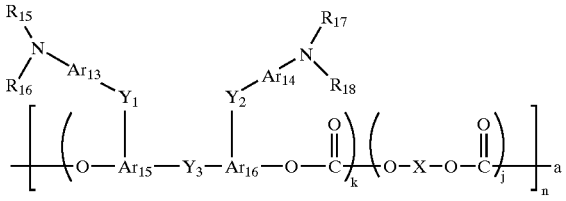

In the Formula 8, $R_{15}$ to $R_{18}$ are each a substituted or non-substituted aryl group. $Ar_{13}$ to $Ar_{16}$ are each an identical or different allylene group. $Y_1$ to $Y_3$ are each single bond, and are each one of a substituted or non-substituted alkylene ether group, a substituted or non-substituted cycloalkylene group, a substituted or non-substituted alkylene ether group, an oxygen atom, a sulfur atom, and a vinylene group. $Y_1$ to $Y_3$ each may be identical or different. "X," "k," "j," and "n" are identical to those of Formula 1.

Formula 9 is shown below.

Formula 9

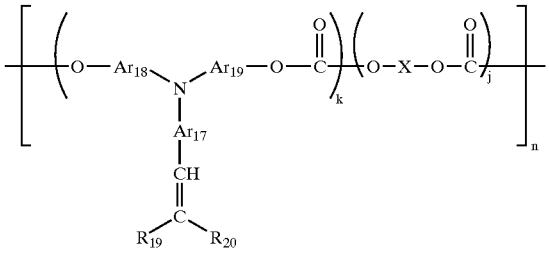

In the Formula 9, $R_{19}$ and $R_{20}$ are each a substituted or non-substituted aryl group, and each may form a ring. $Ar_{17}$ to $Ar_{19}$ are each an identical or different allylene group. "X," "k," "j," and "n" are identical to those of Formula 1.

Formula 10 is shown below.

Formula 7

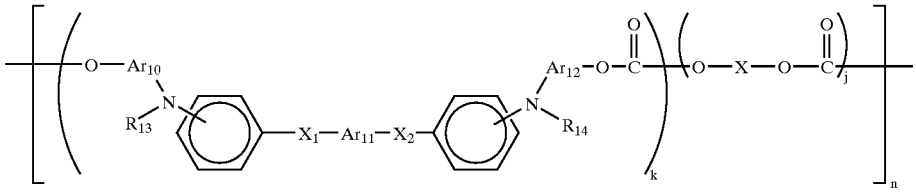

Formula 10

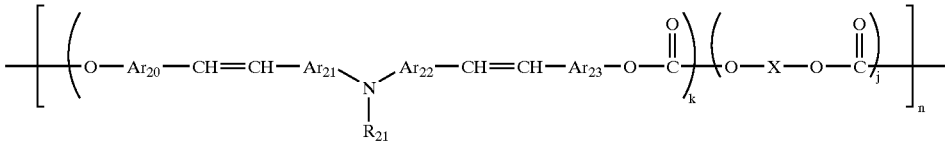

In the Formula 10, $R_{21}$ is a substituted or non-substituted aryl group. $Ar_{20}$ to $Ar_{23}$ are each an identical or different allylene group. "k," "j," and "n" are identical to those of Formula 1.

Formula 11 is shown below.

Formula 11

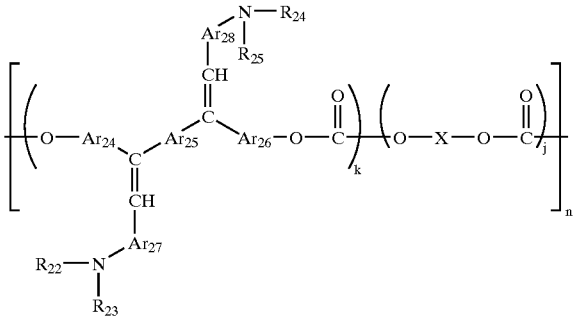

In the Formula 11, $R_{22}$ to $R_{25}$ are each a substituted or non-substituted aryl group. $Ar_{24}$ to $Ar_{28}$ are each an identical or different allylene group. "X," "k," "j," and "n" are identical to those of Formula 1.

Formula 12 is shown below.

Formula 12

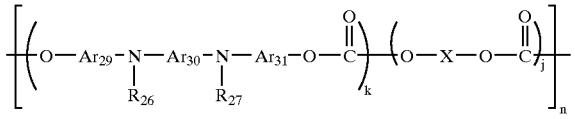

In Formula 12, $R_{26}$ and $R_{27}$ are each a substituted or non-substituted aryl group. $Ar_{29}$ to $Ar_{31}$ are each an identical or different allylene group. "X," "k," "j," and "n" are each identical to those of Formula 1.

For the latent electrostatic image support of the present invention, a plasticizer or levelling agent may be added to the charge transporting layer 37. Examples of the plasticizer include those used as a plasticizer for resins such as dibutyl phthalate, dioctyl phthalate, and the like. The amount of the plasticizer to be used is preferably 0% by weight to 30% by weight relative to a binder resin. Examples of the levelling agent include silicone oil, such as dimethyl silicone oil, methylphenyl silicone oil, or the like, a polymer or an oligomer having a perfluoroalkyl group in a side chain thereof, and the like. The amount of the levelling agent to be used may suitably be 0% by weight to 1% by weight relative to the binder resin.

Next, the latent electrostatic image support having a single layer structure, an example of which is the single layer-photoconductive layer 33, will be described. The single layer photoconductor may contain a photoconductive layer in which at least the charge generating substances are dispersed in the binder resin. The single layer-photoconductive layer is formed by dissolving or dispersing the charge generating substances and the binder resin into a suitable solvent. The solvent is then coated and dried, so as to form the single layer-photoconductive layer. The single layer-photoconductive layer may also be a functionally separate type photoconductive layer, to which the aforesaid charge transport substances have been added. The above examples may suitably be used for the charge transport substances. If necessary, a plasticizer, levelling agent or antioxidant can also be added to the photoconductive layer.

Examples of the binder resin used in the single layer photoconductive layer include the binder resins mentioned above for the charge transporting layer 37, and the binder resins mentioned for the charge generating layer 35 may also added to those mentioned for the charge transporting layer 37. The polymer charge transport material mentioned above may also be used as the binder resin. The amount of charge generating substances is preferably 5 parts by weight to 40 parts by weight, relative to 100 parts by weight of the binder resin. The amount of charge transport material is preferable 0 parts by weight to 190 parts by weight, and more preferably 50 parts by weight to 150 parts by weight, relative to 100 parts by weight of the binder resin. The single layer-photoconductive layer 33 may be formed by coating a coating solution. The coating solution may be formed by dispersing a solvent and, if necessary, together with a binder resin, using a dispersing machine or the like. Examples of the solvent include tetrahydrofuran, dioxane, dichlorothane, cyclohexane, and the like. Examples of coating methods include immersion coating, spray coating, bead coating, nozzle coating, spinner coating, ring coating, and the like.

The film thickness of the single layer photoconductive layer is suitably 5 $\mu$m to 100 $\mu$m.

The latent electrostatic image support of the present invention may include an underlayer, which not shown in the figures, may be provided between the electroconducting support 31 and the single layer- or laminated layer-photoconductive layer. The underlayer is generally formed of a resin as its main component. Considering that the photoconductive layer will be coated on the underlayer using a solvent, the resin preferably has high solvent resistance to ordinary organic solvents. Examples of the resin include water-soluble resins such as polyvinyl alcohol, casein, polyacryl acid sodium, and the like, and setting resins forming a three-dimensional lattice structure such as nylon copolymer, melamine resin, phenolic resin, alkyde-melamine resin, epoxy resin, and the like. Finely powdered pigments of metal oxide such as titanium oxide, silica, alumina, zirconium oxide, tin oxide, indium oxide, and the like may also be added to the underlayer in order to prevent Moire patterns and to reduce residual potential.

These underlayers may be formed by coating a suitable solvent, in the same way as the photoconductive layer is formed. The underlayer of the present invention may also comprise a silane coupling agent, a titanium coupling agent, a chromium coupling agent, or the like. Examples of the underlayer additionally include $Al_2O_3$ provided by positive electrode oxidation, organic materials such as polyparaxylylene (parylene), and the like, and inorganic materials such as $SiO_2$, $SnO_2$, $TiO_2$, ITO, $CeO_2$. For the underlayer, those organic materials and the inorganic materials are provided by a vacuum thin-film forming method.

The examples of the underlayer may further include other materials known in the art. The film thickness of the underlayer may suitably be 0 μm to 5 μm.

The latent electrostatic image support used in the present invention may have an intermediate layer between a protecting layer and a single layer-or a laminated layer-photoconductive layer (which is not shown in the figures). The intermediate layer is mainly composed of a binder resin. Examples of the binder resin include alcohol-soluble nylon, water-soluble polyvinyl butyral, polyvinyl butyral, polyvinyl alcohol, and the like. The intermediate layer may be formed by ordinary coating methods as described above. The thickness of the intermediate layer may suitably be 0.05 μm to 2 μm.

To improve durability against the environment, and in particular, to prevent degradation in sensitivity and increase in residual potential, antioxidants, plasticizers, lubricants, ultraviolet radiation absorbing agents, low molecular weight charge transport substances, levelling agents, and the like may also be added to each of the layers. Specific examples of these compounds are given below.

Examples of the antioxidants which may be added to each of the layers include the following (a) to (e). The examples are not limited to the followings.

(a) Phenolic Compounds 2,6-di-t-butyl-p-creosol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6t-butylphenol), 4,4'-butylidene-bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocopherols, and the like.

(b) Paraphenylendiamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinones 2,5-di-t-octyl hydroquinone, 2,6-didodecylhydroquinone, 2-dodecyl hydroquinone, 2-dodecyl-5-chlorohydroquinone, 2-t-octyl-5-methyl hydroquinone, 2-(2-octadecenyl)-5-methyl hydroquinone, and the like.

(d) Organosulfur Compounds dilauryl-3,3'-thiodipropionate, distearyl-3,3'-thiodipropionate, ditetradecyl-3,3'-thiodipropionate, and the like.

(e) Organophosphoric Compounds

Triphenylphosphine, tri(nonyl phenylene)phosphine, tri (dinonylphenyl)phosphine, tricresylphosphine, tri(2,4-dibutylphenoxy)phosphine, and the like.

Examples of the plasticizers which may be added to each of the layers include the following (a) to (m). The plasticizers are not limited to the followings.

(a) Phosphoric Acid Ester Plasticizers

Triphenyl phosphate, tricresyl phosphate, trioctyl phosphate, octyl diphenyl phosphate, trichlorethyl phosphate, cresyldiphenyl phosphate, tributyl phosphate, tri-2-ethylhexyl phosphate, triphenylphosphate, and the like.

(b) Phthalic Acid Ester Plasticizer

Dimethyl phthalate, diethyl phthalate, diisobutyl phtalate, dibutyl phthalate, diheptyl phtalate, di-2-ethylhexyl phtalate, diisooctyl phthalate, di-n-octyl phtalate, dinonyl phthalate, diisononyl phthalate, diusodecyl phthalate, dinonyl phtalate, diisononyl phthalate, diundecyl phthalate, ditridecyl phthalate, dicyclohexyl phthalate, butyl benzyl phthalate, butyl lauryl phthalate, methyl oleyl phthalate, octyl decyl phthalate dibutyl fumarate, dioctyl fumarate, and the like.

(c) Aromatic Carboxylic Acid Ester Plasticizers

Trioctyl trimellitate, tri-n-octyl trimellitate, octyl oxybenzoic acid and the like.

(d) Aliphatic Dibasic Acid Ester Plasticizers

Dibutyl adipate, di-n-hexyl adipate, di-2-ethylhexyl adipate, di-n-octyl adipate, adipate-n-octyl-n-decyl, disodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, tetrahydrophthalate dioctyl, di-n-octyl tetrahydrophthalate, and the like.

(e) Aliphatic Ester Derivatives

Butyl oleate, glycerin monooleic acid ester, methyl acetyl ricinoleate, pentaerythritol ester, dipentaerythritol hexaester, triacetin, tributin, and the like.

(f) Oxyacid Ester Plasticizers

Methyl acetyl ricinoleate, butyl acetyl ricinoleate, butylphthalyl-butyl glycolate, tributyl acetyl citrate, and the like.

(g) Epoxy Plasticizers

Epoxidized soya bean oil, epoxidized linseed oil, butyl epoxy stearate, decyl epoxy stearate, octyl epoxy stearate, benzil epoxy stearate, epoxy hexahydro phthalate, epoxy hexahydrodidecyl phthalate, and the like.

(h) Dihydric Alcohol Ester Plasticizers

Diethylene glycol dibenzoate, triethylene glycol di-2-ethyl butyrate, and the like.

(i) Chlorine-Containing Plasticizers

Chlorinated paraffin, chlorinated diphenyl, chlorinated aliphatic acid methyl ester, methoxychlorinated aliphatic methyl ester, and the like.

(j) Polyester Plasticizers

Polypropylene adipate, polypropylene sebacate, polyester, acetylated polyester, and the like.

(k) Sulfonic Acid Derivatives

P-toluene sulfon amide, o-toluene sulfon amide, p-toluene sulfone ethylamide, o-toluene sulfone ethylamide, toluene sulfone-N-ethylamide, p-toluene sulfone-N-cyclohexyl amide, and the like.

(l) Citric Acid Derivatives

Triethyl citrate, triethyl acetyl citrate, tributyl citrate, tributyl acetyl citrate, tri-2-ethylhexyl acetyl citrate, acetyl citric acid-n-octyl decyl, and the like.

(m) Other

Terphenyl, partially hydrogenated terphenyl, camphor, 2-nitro diphenyl, dinonyl naphtalene, methyl abietate, and the like.

Examples of the lubricants which may be added to each layer include the following (a) to (h). The lubricants are not limited to the followings.

(a) Hydrocarbon Compounds

Fluid paraffin, paraffin wax, microwax, low polymerization polyethylene, and the like.

(b) Aliphatic Compounds

Lauric acid, myristic acid, palmitic acid, stearic acid, arachidic acid, behenic acid, and the like.

(c) Aliphatic Acid Amide Compounds

Stearyl amide, palmityl amide, olein amide, methylene bis-stearoamide, ethylene bis-stearoamide, and the like.

(d) Ester Compounds

Lower alcohol esters of aliphatic acids, polyhydric alcohol ester of aliphatic acids, aliphatic acid polyglycol esters, and the like.

(e) Alcohol Compounds

Cetyl alcohol, stearyl alcohol, ethylene glycol, polyethylene glycol, polyglycerol, and the like.

(f) Metal Soaps

Lead stearate, cadmium stearate, barium stearate, calcium stearate, zinc stearate, magnesium stearate, and the like.

(g) Natural Waxes

Carnuba wax, candelila wax, bees wax, spermaceti wax, purified insect wax, montan wax, and the like.

(h) Other

Silicone compounds, fluorine compounds, and the like.

Examples of the ultraviolet radiation absorbing agents which may be added to each layer are the following (a) to (f). The ultraviolet radiation absorbing agent is not limited to the followings.

(a) Benzophenone Ultraviolet Radiation Absorbing Agent 2-hydroxybenzophenone, 2,4-dihydroxybenzophenone, 2,2',4-trihydroxybenzophenone, 2,2',4,4'-tetrahydroxy benzophenone, 2,2'-dihydroxy-4-methoxybenzophenone, and the like.

(b) Salicylc Acid Ultraviolet Radiation Absorbing Agent

Phenyl salicylate, 2,4-di-t-butylphenyl-3,5-di-t-butyl-4-hydroxybenzoate, and the like.

(c) Benzotriazole Ultraviolet Radiation Absorbing Agent (2'-hydroxyphenyl) benzotriazol, (2'-hydroxy-5'-methylphenyl) benzotriazole, (2'-hydroxy-3'-tert-butyl5'-methylphenyl) 5-chlorobenzotriazole, and the like.

(d) Cyanoacrylate Ultraviolet Radiation Absorbing Agent

Ethyl-2-cyano-3,3-diphenyl acrylate, methyl-2-carbomethoxy-3-(paramethoxy) acrylate, and the like.

(e) Quenchers (Metal Complex Salt)

Nickel (2,2'-thio bis (4-t-octyl) phenolate) normal butyl amine, nickel dibutyl dithiocarbamate, cobalt dichrohexyldithiophosphate, and the like.

(f) HALS (Hindered Amines)

Bis (2,2,6,6-tetramethyl-4-piperidyl) sebacate, bis (1,2,2,6,6,-pentamethyl-4-piperidyl) sebacate, 1-[2-{3-(3,5-di-t-butyl-4-hydroxyphenyl) propionyloxy}ethyl]-4-{3-(3,5-di-t-butyl-4-hydroxyphenyl) propionyloxy}-2,2,6,6-tetramethylpyridine, 8-benzil-7,7,9,9-tetramethyl-3-octyl-1,3,8-triazaspiro {4,5}undecane-2,4-dione, 4-benzoyloxy-2,2,6,6-tetramethylpiperidine, and the like.

<Image-Forming Apparatus>

An electrophotographic apparatus, which is an example of the image-forming apparatus of the present invention, will now be described in detail with reference to the drawings.

Figure 5:
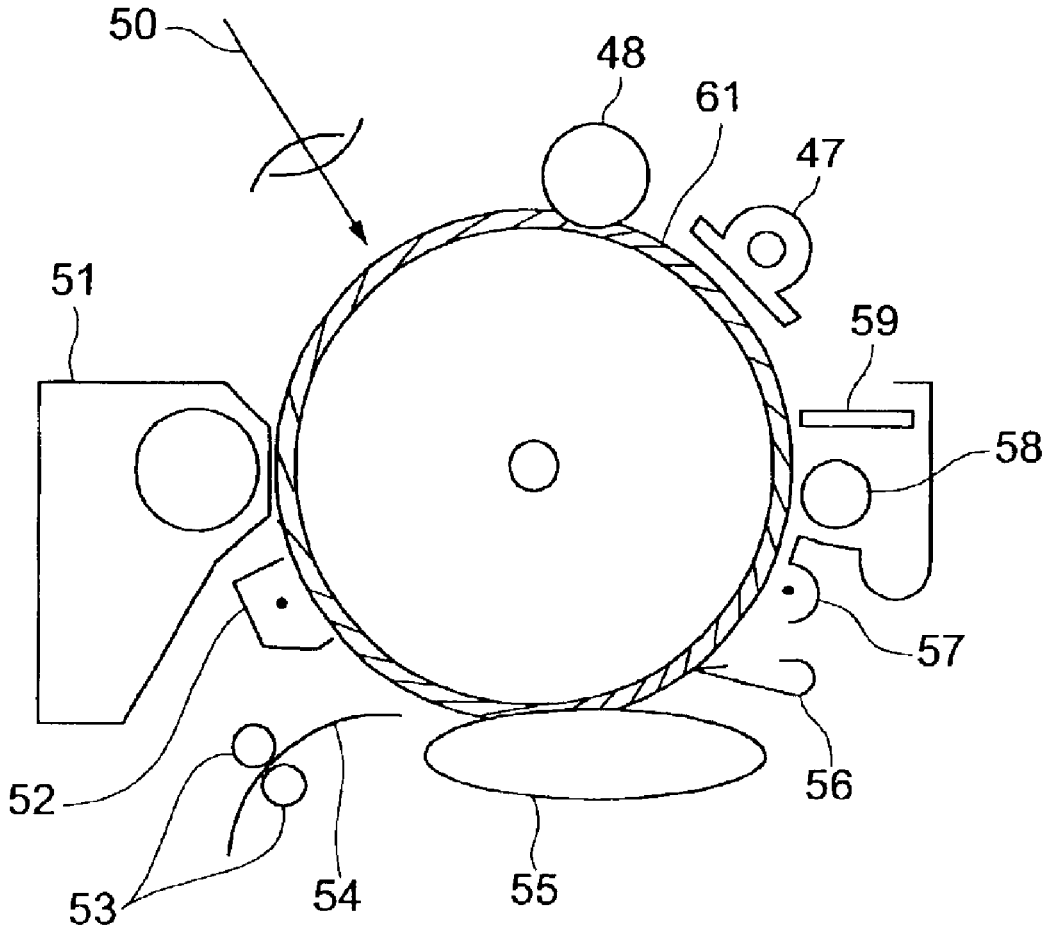
FIG. 5 is a schematic sectional view showing one example of the image-forming apparatus of the present invention.

FIG. 5 is a sectional view of one example of an electrophotographic apparatus for the purpose of describing the image-forming apparatus of the present invention. However, the present invention is not limited to FIG. 5. Various modifications can be applied to the figure, which are still within the scope of the appended claims.

Referring into FIG. 5, a latent electrostatic image support 61 comprises a photoconductive layer on an electroconductive support, and an outermost layer containing a filler. The latent electrostatic image support 61 is shown as drum-shaped, though, it may be sheet-shaped, or endless belt. A charging member 48 is disposed in contact with or in the vicinity of the latent electrostatic image support 61. If necessary, a pre-transfer charger 52, a transfer charger, a separator charger or a pre-cleaning charger 57 may be provided, all of which are known in the art. Examples of the charging member include a corotron, a scorotron, a solid-state charger, a charging roller, and the like. When the latent electrostatic image support is charged by the charging member 48, the charging member 48 is applied with an electric field in which an alternating current is superimposed to a direct current, which is effective in reducing non-uniform charging. Examples of the transfer include the aforementioned chargers. A suitable example is a charger having a transferring belt, as shown in FIG. 5.

The light source for an image exposure part (light irradiator) 50 and a charge eliminator 47 may be any common light-emitting materials such as a fluorescent light, tungsten lamp, halogen lamp, mercury lamp, sodium lamp, light-emitting diode (LED), semiconductor laser (LD), electroluminescence (EL) element, or the like. Various filters may also be used in order to irradiate only a light having a desired wavelength. Examples of the filters include a sharp cut filter, a band pass filter, a near infrared cut filter, a dichroic filter, an interference filter, a conversion filter for color temperature, and the like. In addition to the steps shown in FIG. 5, irradiating the latent electrostatic image support with the aforementioned light sources is attained with more steps such as a transferring step with light irradiation, a charge eliminating step, cleaning step, a step of pre-exposure, or the like.

Toners developed on the latent electrostatic image support 61 by a developing unit 51 are transferred onto a transfer paper 54 that is inserted to a transfer member by resist rollers 53, and the transfer paver 54 is then separated from the latent electrostatic image support 61 by a separation pawl 56. Here, not all of the toners are transferred. Some of the toners remain on the latent electrostatic image support 61. These remained toners are removed from the latent electrostatic image support 61. These remained toners are removed from the latent electrostatic image support 61 by a fur brush 58 and a cleaning rush 59. The toners are removed also by the cleaning brush alone. Examples of the cleaning brushes include those known in the art such as a fur brush, a magnetic fur brush, and the like.

A latent electrostatic image is formed by charging a positive (negative) charging, and by irradiating a light to a positive or negative latent electrostatic image. When the latent electrostatic image is developed with negative (positive) toners, a positive image is formed. When the latent electrostatic image is developed with positive (negative) toners, a negative image is formed. Examples of the image developer include any known methods in the art. Examples of the charge-eliminator also include any known methods in the art.

The image-forming apparatus of the present invention may further comprise one or more of latent electrostatic image supports, wherein each of the latent electrostatic image supports has a monochromatic toner image, and the monochromic toner image is sequentially disposed onto a recording medium, so as to form a color image. The image-forming apparatus of the present invention may further comprise an intermediate transfer configured to transfer the monochromatic toner image on each of the latent electrostatic image supports, and to transfer the monochromatic toner image onto a medium, wherein the monochromatic toner image on each of the latent electrostatic image supports is sequentially disposed, so as to form a color image, and the color image is transferred onto a recording medium. Moreover, the image-forming apparatus of the present invention may provide a seamless belt as the intermediate transfer. Whole or a portion of a layer of the seamless belt is preferably an elastic belt formed of an elastic material.

Figure 6:
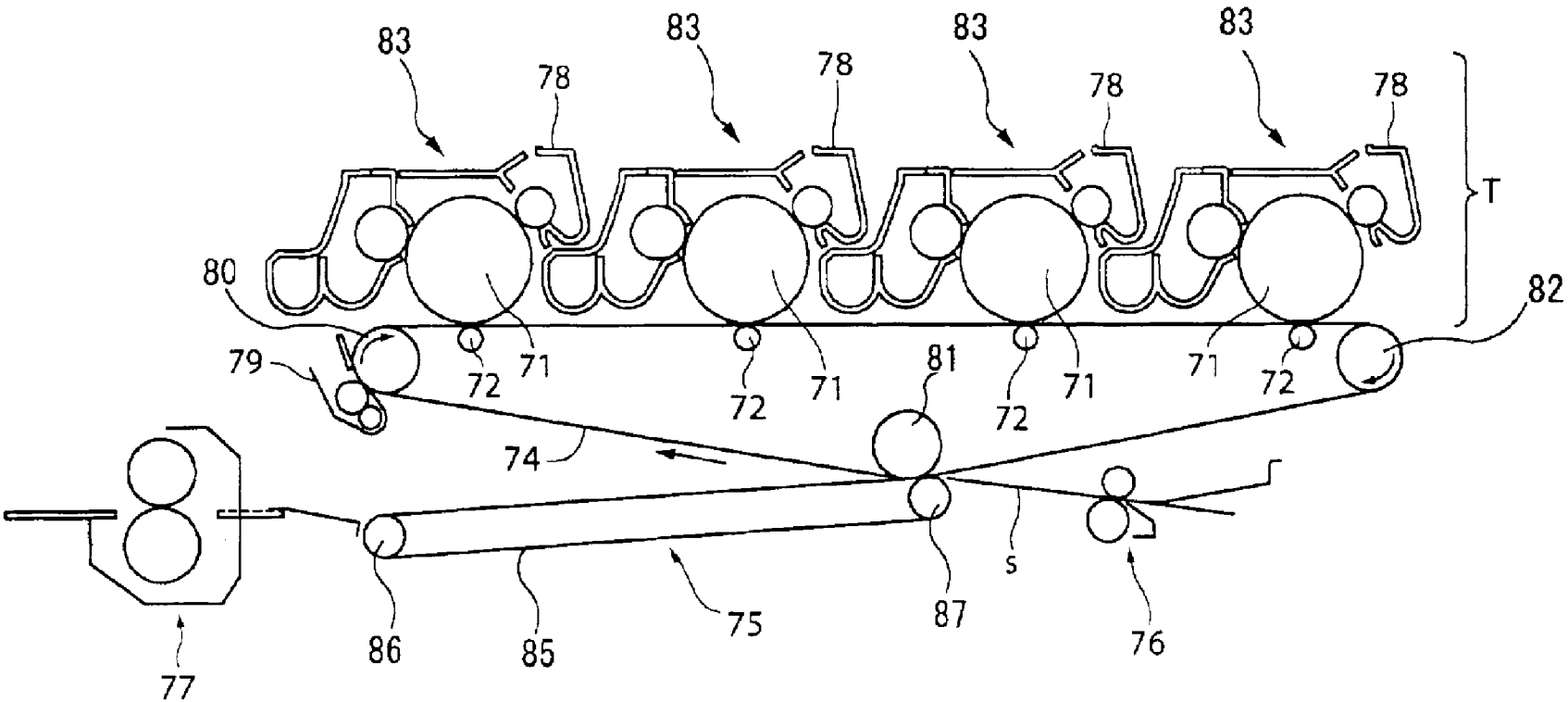
FIG. 6 is a schematic sectional view showing another example of the image-forming apparatus of the present invention.

Referring into FIG. 6, an intermediate transfer such as a primary intermediate transfer belt 74, which is an endless transfer belt, is spanned around three support rollers 80, 81, and 82. The primary intermediate transfer belt 74 is rotated clockwise.

A cleaning device such as the intermediate transfer belt cleaning unit 79 is provided on the left side of the support roller 80. The cleaning unit 79 cleans the residual toners on the intermediate transfer belt 74 after an image is transferred.

Four of image-forming units 83 are installed, facing the primary intermediate transfer belt 74 on a portion spanned around the support rollers 80 and 82 in a direction along with transporting.

The image-forming units 83 each have toners of cyan, yellow, mageneta and black, so as to form a monochromic toner image. Monochromic toner images are formed on each of the latent electrostatic image supports 71, and then are transferred onto the primary intermediate transfer belt 74 with the assistance of primary transfer rollers 72. Furthermore, the elastic belt gives less pressure to the toner layers during transferring. Note at "T" showed in FIG. 6 refers to a process cartridge.

The secondary transfer unit 75 is provided underneath the primary intermediate transfer belt 74. The secondary transfer unit 75 includes the secondary intermediate transfer belt 85, which is also an endless belt. The secondary intermediate transfer belt 85 is spanned around support rollers 86 and 87. After monochromic toner images are formed in the image-forming unit 83, they are primary transferred onto the intermediate transfer belt 74 so as to form a color image, and the color image is transferred, at once, onto a recording medium using the secondary intermediate transfer belt 85.

Materials for the intermediate transfer belts include a fluorine resin, a polycarbonate resin, a polyimide resin, and the like. Recently, an elastic belt is used as the intermediate transfer belt. In the elastic belt, all or a part of the layers of the belt are formed of elastic materials.

Transferring a color image using an ordinary resin belt has the following problems.

A color image is usually formed by the color toners of four colors. The color image on a recording medium comprises the toner layers including the first to fourth toner layers. It should be noted that each toner layers are formed of each color toners of four colors. The toner layers are pressurized, when the toner layers are subjected to a primary transfer to the intermediate transfer belt 74 from the latent electrostatic image supports 71, and then to a secondary transfer to the recording medium from the intermediate transfer belt 74. Here, the toner particles become highly aggregated.

The high aggregation among toner particles tends to cause spotting on a character, and ruining an edge of a solid image.

A resin belt is not likely to become deformed in accordance with the toner layers. The toner layers are likely to become compressed, pressurized and then deformed. Accordingly, the spotting on an image or a character tends to occur.

Moreover, there is an increasing demand of giving irregularity to a sheet (recording medium), such as Japanese paper, when forming an image by a full color image forming apparatus.

Giving irregularity to a sheet usually results in spottings on an image, when the image is transferred.

In order to strengthen the toner's adhesion to intermediate transfer belts, the toner layers are more strongly pressurized when a transfer pressure at the secondary transfer unit is raised. The image is accordingly more likely to have spottings thereon.

The elastic belt is preferably used by the following reason.

Since the elastic belt is less harder than a resin belt. The elastic belt is flexibly bent or spanned as the toner layers and/or the recording medium having irregularity are transferred. A toner image can be formed on the recording medium having irregularity, accordingly. Good adhesion between the intermediate transfer belts and the toner layers can also be achieved because of the elastic belt. Furthermore, the elastic belt gives less pressure to the toner layers during transferring.

Examples of the material for the elastic belt include resins.

Examples of the resin include polycarbonate, fluorine resin (ETFE, PVDF), polystyrene, chloropolystyrene, poly-alpha-methyl styrene, styrene butadiene copolymer, styrene vinyl chloride copolymer, styrene vinyl acetate copolymer, styrene maleic acid copolymer, styrene acrylic-ester copolymer (styrene methyl acrylate copolymer, styrene ethyl acrylate copolymer, styrene butyl-acrylate copolymer, styrene acrylic acid octyl copolymer, styrene acrylic acid phenyl copolymer, or the like), styrene methacrylic-ester copolymer (styrene methyl methacrylate copolymer, styrene ethyl-methacrylate copolymer, styrene methacrylic acid phenyl copolymer, or the like), styrene resin (homopolymer or copolymer containing styrene or styrene substitution product), styrene-alpha-chloromethyl acrylate copolymer and styrene acrylonitrile acrylic-ester copolymer, polymethyl methacrylate, butyl methacrylate resin, ethyl acrylate resin, butyl-acrylate resin and denaturation acrylate resin (silicone denaturation acrylate resin), vinyl chloride resin, vinyl chloride resin denaturation acrylate resin and acrylic urethane resin, styrene vinyl acetate copolymer, vinyl chloride vinyl acetate copolymer, rosin denaturation maleic resin, phenol resin, epoxy resin, polyester resin, polyester polyurethane resin, polyethylene, polypropylene, polybutadiene, polyvinylidence chloride, ionomer resin, polyurethane resin, silicone resin, ketone resin, ethylene ethyl acrylate copolymer, xylene resin and polyvinyl butyral resin, polyamide resin, denaturation polyphenylene-oxide resin, and the like. These resins can be used either alone or in combination of two or more.

Examples of an elastomer which forms the elastic belt include isobutylene-isoprene rubber, fluorine rubber, acrylic rubber, EPDM, NBR, acrylonitrile butadiene styrene rubber natural rubber, polyisoprene rubber, styrene butadiene, butadiene rubber, ethylene propylene rubber, ethylene propylene terpolymer, polychloroprene rubber, chloro sulfonation polyethylene, chlorinated polyethylene, polyurethane rubber, syndiotactic-1,2-polybutadiene, epichlorohydrin rubber, silicone rubber, fluororubber, polysulfide rubber, hydrogenation nitrile rubber, thermoplastic elastomer (for example, elastomer including polystyrene, polyolefine, polyvinyl chloride, polyurethane, polyamide, polyurea, polyester, fluororesin, or the like), and the like. Those can be used either alone or in combination of two or more.

There is no particular limitation on an electric conductive agent which can be added to the elastic belt for a purpose of resistance to regulation.

Examples of the electric conductive agent include barium sulfate, magnesium silicate, calcium carbonate, or the like. Specific examples of the electric conductive agent include conductive metal oxides such as metal powders, carbon black, graphite, aluminium, nickel, tin oxide, titanium oxide, antimony oxide, oxidation indium, potassium titanate, antimony-oxide fin-oxide multiple oxide (ATO), oxidation indium tin-oxide multiple oxide (ITO), conductive metal oxide, and the like.

There is no particular limitation on materials for the outermost layer of the latent electrostatic image support, as long as the materials reduce the adhesion force of the toner to the transfer belt surface and raise the secondary transfer properties. Examples of the materials for the outermost layer include polyurethane, polyester, epoxy resin, and the like. These can be used either alone or in combination of two or more. Materials that raise releaseability of toners can also be used. Examples of the materials include fluororesin, fluorine compound, fluoridation carbon, titanium oxides, silicone carbide, and the like.

In addition, the heat-treated fluorine rubber material may also be used. The heat-treated fluorine has the fluorine rich surface and the surface energy of the intermediate transfer belts is reduced.

A method of manufacturing the elastic belt is not particularly limited, and any of the following methods may be used:

the centrifugal casting method in which materials are introduced into the rotating mold having a cylinder form, and forms the elastic belt;

the spray coating method in which a surface of the elastic belt becomes thin;

the dipping method in which the mold having a cylinder form is soaked or dipped into the solution of source material, and is then taken out from the solution;

the casting method in which source material is poured into a space between the inner and outer cores of the mold.

the method in which a compound is provided around the mold having a cylinder form, and vulcanization polishing is performed.

The elastic belt can be manufactured by combining two or more of these methods.

A rubber layer can be provided in a core resin layer of the elastic belt in order to prevent elongation. It is also possible to contain the materials in the core layer, or the like of the elastic belt.

The present invention is not limited to those methods.

Examples of the materials that can be contained in the core layer of the elastic belt include textile fabrics, yarns using one chosen from the group including metal fibers, inorganic fibers, synthetic fibers, natural fibers, such as cotton and silk, polyester fibers, nylon fibers, acrylic fibers, polyolefine fibers, vinylon, polyvinyl chloride fibers, polyvinylidence chloride fibers, polyurethane fibers, polyacetal fibers, polyfluoroethylene fibers, phenol fibers, carbon fibers, glass fibers, boron fibers, iron fibers, copper fibers, and the like. The present invention is not limited to these materials.

Yarns may be twisted yarns, such as those with one or plural filaments twisted, single-strand yarns, plied yarns, double thread yarns, or the like. Moreover, it is possible to mix the fibers of different kinds chosen from the examples of the materials.

There is no particular limitation on the method of manufacturing the core layer.

For example, the textile fabrics woven in the shape of a pipe can be provided on the metal pattern, the method of preparing a covering layer on it, the method of the textile fabrics woven in the shape of a pipe being dipped in the liquid rubber, and preparing a covering layer in one side or both sides of the core layer, and yarns can be spirally twisted around the metal pattern in arbitrary pitch, and the method of preparing a covering layer on it.

The thickness of the elastic belt varies depending on the hardness of the elastic belt. If the elastic layer is too thick, contraction and expansion on the surface of the elastic belt become more apparent, and the elastic belt shows a crack on the surface.

It is not preferable that the elastic belt is too thick (about 1 mm or more), with the increasing contraction and expansion on the surface.

According to the present invention, a proper range of the hardness HS of the elastic belt is expressed by the conditions of: 10.Itoreq.HS.Itoreq.65 degrees (JIS-A).

Adjustment of the suitable hardness is required with the layer thickness of the elastic belt. The material having a hardness below 10 degrees (JIS-A) has a difficulty in forming of the elastic layer with a sufficient dimensional accuracy. This problem arises from that it is likely to receive contraction and expansion at the time of molding.

Ordinarily, the oil component is contained in the base material for the elastic belt, in order to soften it. If transferring is continuously carried out in a state of pressurization, the oil component oozes out from the elastic belt serving as the intermediate transfer belt to the latent electrostatic image support serving as the photoconductor. It is found that the oil component adheres to the image, and a horizontal belt-like irregularity appears on the image.

On the other hand, the material having a hardness above 65 degrees (JIS-A) provides the ability to form the elastic belt with a sufficient accuracy. The oil adhesion over the photoconductor can be reduced, but spottings on an image cannot be prevented.

Moreover, firm bridging to the firm-bridging roller becomes difficult.

The image-forming process-cartridge of the present invention include a contacting-type image developer configured to have a developer, a developer bearing member which has a developer on a surface thereof, and rotates with carrying the developer, and a developer limiting member which controls an amount of the developer; and a latent electrostatic image support configured to contain a filler on an outermost layer thereof. The image-forming process cartridge of the present invention is formed in a one-piece construction and is attachable to and detachable from an image-forming apparatus, the developer is a double-component developer which contains a magnetic carrier and a toner, the image developer develops a latent electrostatic image with the developer, the magnetic carrier has a coating layer which is formed of a binder resin with particles retained on a surface of the magnetic carrier, and a ratio of a particle diameter D1 of the particles to a film thickness h1 of the binder resin satisfies a relation of $1<D1/h1<10$.

Figure 7:
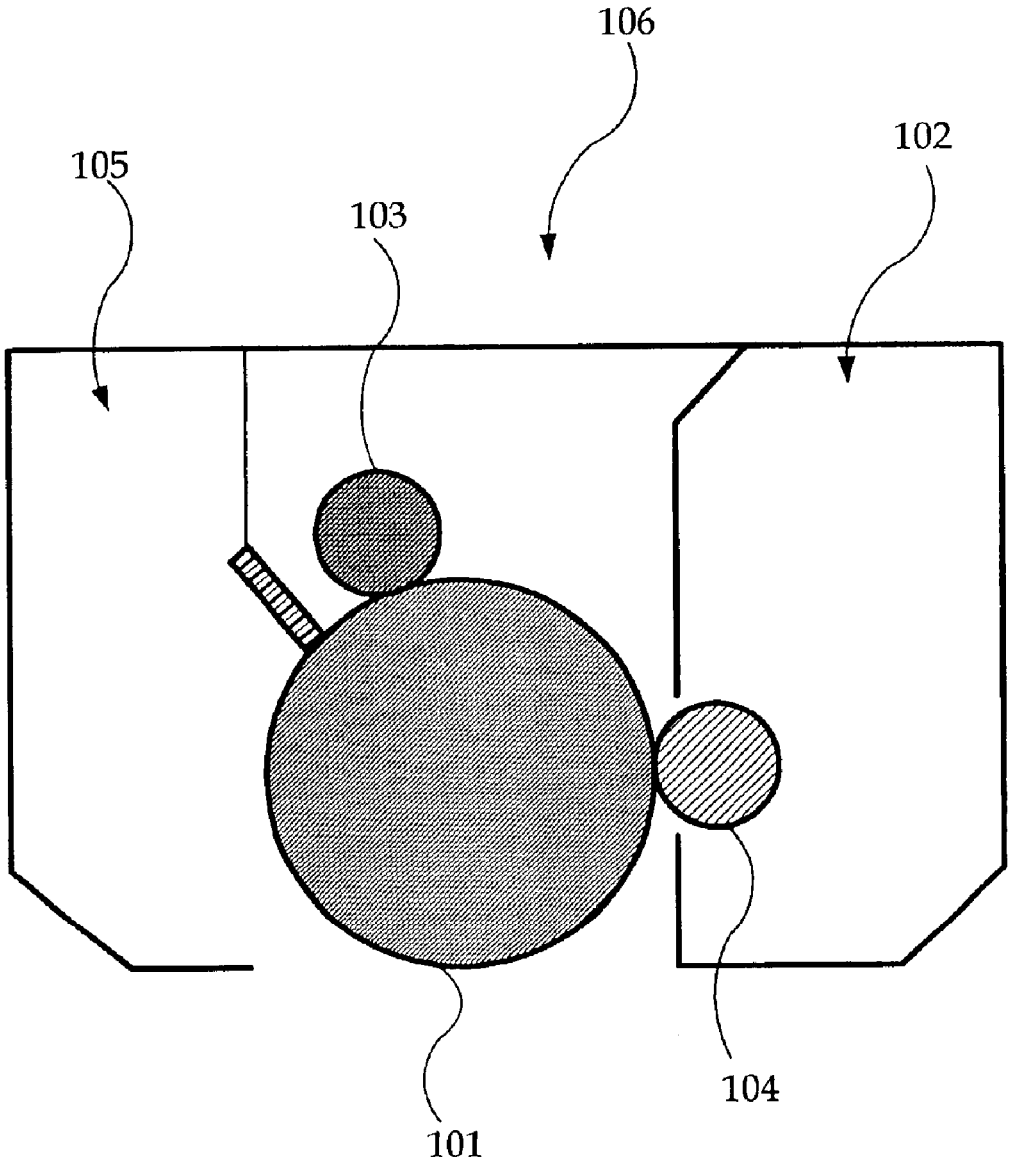
FIG. 7 is a schematic view showing an example of the image-forming process cartridge of the present invention.

Referring into FIG. 7, an image-forming process unit (process cartridge) 106, having a photoconductor drum 101 which functions as a latent electrostatic image support, a charging roller 103 which functions as a charger, a cleaner 105 which functions as a cleaner and an image developer 102 which functions as an image developer. The image developer 102 has a developer sleeve 104. The charging roller 103 apply charge to the photoconductor drum 101, the charged photoconductor drum 101 forms a latent electrostatic image thereon after exposure, the image developer 102 supply the toner therein to the latent electrostatic image using the developer sleeve 104 so as to develop the latent electrostatic image, and then the cleaner 105 cleans the excess toner from the photoconductor drum 101 after transferring the developed image to a recording material or the like. All of these members are formed in a one-piece construction, which can be removed from an image-forming apparatus.

The present invention will now be described in further detail with Examples and Comparative Examples. It should be understood that the present invention is not limited to the Examples and the Comparative Examples.

EXAMPLE 1

Toners and magnetic carriers were first manufactured, and a double-component developer was then manufactured by using the toners and the magnetic carriers. A latent electrostatic image support was manufactured, on the other hand. The double-component developer and the latent electrostatic image support were installed so as to fabricate an image-forming apparatus. Images formed by the image-forming apparatus were then evaluated.

| -Manufacture of toner- | |
|---|---|
| Styrene-acrylic resin (Sanyo Chemicals, Co., Ltd. Himer 75) | 85.0 parts |
| Carbon black (MITSUBISHI CHEMICAL CORPORATION, #44) | 8.0 parts |
| Metal-containing azo dye (Orient Chemical Industries, Ltd. Bontron S-34) | 2.0 parts |
| Carnuba wax (CERICA NODA Co., Ltd., WA-03) | 5.0 parts |

A mixture of those components was melted and kneaded by a heat roller at 140° C. The mixture was then cooled and solidified. Thereafter, the mixture was crushed by a jet mill, and was classified to obtain toners having an average particle diameter of 8.0 μm.

0.7% of hydrophobic silica, R-972 (Nippon Aerogel K.K.) was mixed with 100 parts by weight of the toners by a Henschel mixer to obtain a toner in a final state.

| -Manufacture of magnetic carrier- | |
|---|---|
| A Solution for forming a Coating layer | |
| Acrylic resin solution (solids: 50% by weight) | 56.0 parts |
| Guanamine solution (solids: 77% by weight) | 15.6 parts |
| γ-(2-aminoethyl) aminopropyltrimethoxysilane | 6.0 parts |
| Alumina particles [average particle diameter: 0.6 μm, specific resistance: $10^{14}$ Ω · cm] | 160.0 parts |
| Toluene | 900.0 parts |
| Butyl cellusolve | 900.0 parts |

The above components were dispersed by a homomixer for 10 minutes, and a solution for forming a coating layer was thus prepared. Calcined ferrite powder [F-300: average particle diameter: 50 μm (produced by Powder-Tech Co., Ltd.)] for a core material, and the solution for forming a coating layer were coated on a surface of the core material by a spiracoater (Okada Seiko) so as to give a film thickness of 0.15 μm, and was then dried. After cooling, the ferrite powder bulk was crushed, using a screen having an aperture of 100 μm, so as to give the carrier. A film thickness of a binder resin was measured by observing a section of a carrier with a transmitting electron microscope. The film thickness of the binder resin was measured as the average film thickness of a coating film, which was the coating layer, and covered a surface of the carrier. A ratio (D1/h1) of the film thickness of the coating layer of a carrier, and a particle diameter of a particle in the coating layer was shown in Table 1.

| -Manufacture of double-component developer- | |
|---|---|
| Toners of the above-described | 4.0 parts |
| Magnetic carriers of the above-described | 96.0 parts |

The toners and the magnetic carriers were mixed in a turbular mixer for 10 minutes, so as to manufacture the double-component developer.

-Manufacture of Latent Electrostatic Image Support-

A coating solution for an underlayer, a coating solution for a charge generating layer, and a coating solution for a charge transporting layer, each of which was formed of the following compositions, were sequentially coated on an aluminium cylinder and dried to give a latent electrostatic image support which has a 3.5 μm underlayer, a 0.2 μm charge generating layer, a 22 μm charge transporting layer, and a 6 μm protecting layer. Coating Solution for Forming an Underlayer

| | |
|---|---|
| Titanium dioxide powder | 400.0 parts |
| Melamine resin | 65.0 parts |
| Alkyde part | 120.0 parts |
| 2-butanone | 400.0 parts |

Coating Solution for a Charge Generating Layer

| | |
|---|---|
| Bis-azo pigment represented by the following Formula 13 | 8.0 parts |
| Triazo pigment represented by the following Formula 14 | 6.0 parts |
| Polyvinylbutyral | 5.0 parts |
| 2-butanone | 200.0 parts |
| Cyclohexanone | 400.0 parts |

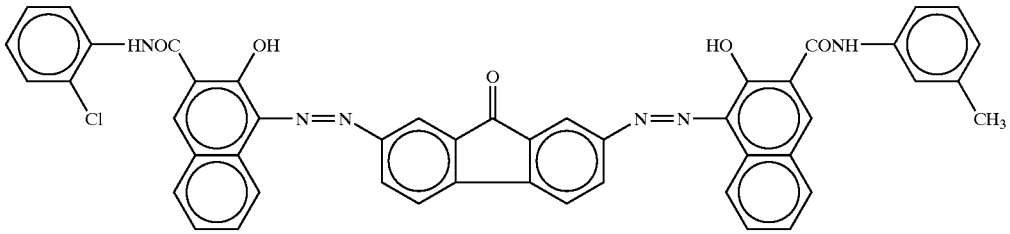

Formula 13

-continued

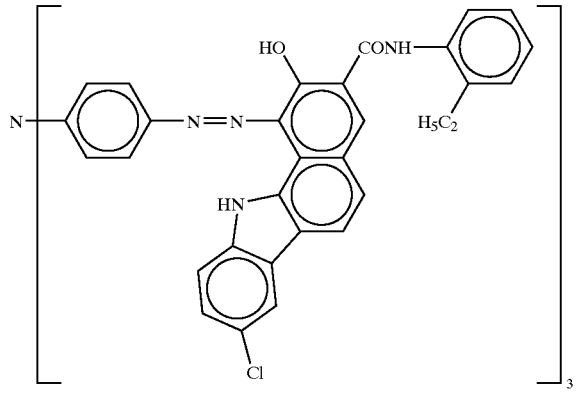

Formula 14

Coating solution for charge transporting layer

| | |
|---|---|
| A-type polycarbonate | 10.0 parts |
| Cyclohexanone | 150.0 parts |
| Charge transport material represented by the following Formula 15 | 7.0 parts |
| Tetrahydrofuran | 400.0 parts |

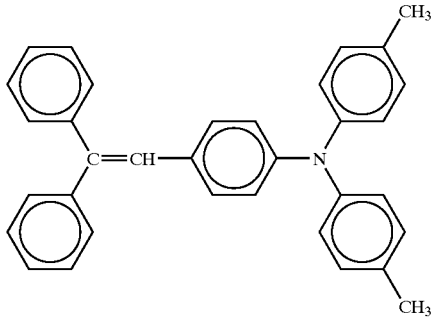

Formula 15

Protecting layer coating solution

| | |
|---|---|
| Z-type polycarbonate | 10.0 parts |
| Charge transport material represented by the following Formula 16 | 8.0 parts |
| Alumina particles (average particle diameter 0.6 $\mu$m) | 4.0 parts |
| Tetrahydrofuran | 400.0 parts |
| Cyclohexanone | 150.0 parts |

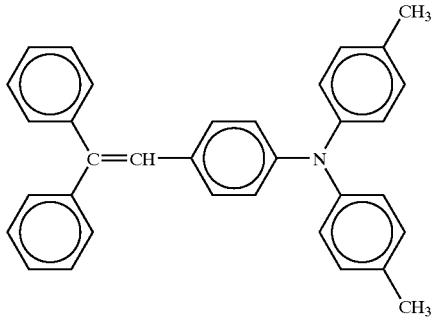

Formula 16

The developer and the latent electrostatic image support obtained as described above were installed into the Imagio MF250 produced by Ricoh Co., Ltd., which is the image-forming apparatus of Example 1.

EXAMPLES 2–10, COMPARATIVE EXAMPLES 1–4

In order to verify the effectiveness of the present invention, samples were manufactured with different film thickness of resin for constituting the coating layer of the magnetic carrier and a different particle diameter of the alumina particles, so as to have a structure of the coating layer as shown in the Table 1. A latent electrostatic image support was manufactured with a different film thickness of the outermost layer and a different filler particle diameter as shown in Table 2. Developers and latent electrostatic image supports were manufactured in an identical way to that of Example 1, except that the film thickness of resin and the particle diameter of the coating layer, and the outermost layer film thickness and a filler particle diameter of the latent electrostatic image support, were changed. The developer and the latent electrostatic image supports were installed into the Imagio MF250 produced by Ricoh Co., Ltd. as the image-forming apparatuses 2 to 14. As shown in Table 1 and Table 2, the image-forming apparatuses 2 to 10 which are the image-forming apparatuses of the present invention were used for Examples 2 to 10. The image-forming apparatuses 11 to 14 manufactured for a comparison were used for Comparative Examples 1 to 14.

(Evaluation)

Using the image-forming apparatuses 1 to 14, repeat photocopying tests were carried out. Evaluation was then conducted for a blurred image, which is the primal object of the present invention. Evaluation for abnormalities on an image, which occurred during the repeat photocopying tests, was also carried out. The results of the evaluation are shown in Table 3. In Talbe 3, "at the start" indicates that each of the image-forming apparatuses was started (turned on) after leaving turned off for 12 hours. Hereinafter, "A4" refers to a sheet of paper sized 210 mm×297 mm.

The evaluation was carried out as follows:

| | |
|---|---|
| Photocopied image: | 6% character chart |
| Copying mode: | Continuous mode, A4 crossfeed |
| The number of test copies: | 5000 sheets/day |

TABLE 1

Carrier coating layer compositions used in image-forming apparatuses

| | | Structure of Carrier coating layer | | | |
|---|---|---|---|---|---|
| | | Film Thickness of Resin h1 μm | Particle diameter D1 μm | D1/h1 — | Content of Particles % by weight |
| Image-forming apparatus 1 | Example 1 | 0.15 | 0.6 | 4 | 67.3 |
| Image-forming apparatus 2 | Example 2 | 0.15 | 0.6 | 4 | 67.3 |
| Image-forming apparatus 3 | Example 3 | 0.15 | 0.6 | 4 | 67.3 |
| Image-forming apparatus 4 | Example 4 | 0.15 | 0.6 | 4 | 67.3 |
| Image-forming apparatus 5 | Example 5 | 0.15 | 0.6 | 4 | 67.3 |
| Image-forming apparatus 6 | Example 6 | 0.15 | 0.6 | 4 | 67.3 |
| Image-forming apparatus 7 | Example 7 | 0.15 | 0.3 | 2 | 67.3 |
| Image-forming apparatus 8 | Example 8 | 0.15 | 1.2 | 8 | 67.3 |
| Image-forming apparatus 9 | Example 9 | 0.15 | 0.6 | 4 | 40 |
| Image-forming apparatus 10 | Example 10 | 0.08 | 0.6 | 7.5 | 85 |
| Image-forming apparatus 11 | Comp. Ex. 1 | 0.15 | 0.1 | 0.67 | 75 |
| Image-forming apparatus 12 | Comp. Ex. 2 | 1 | 0.6 | 0.6 | 75 |
| Image-forming apparatus 13 | Comp. Ex. 3 | 0.15 | 2 | 13.3 | 75 |
| Image-forming apparatus 14 | Comp. Ex. 4 | 0.03 | 0.6 | 20 | 75 |

TABLE 2

Structure of outermost layer of Latent electrostatic image support used in image-forming apparatuses

| | | Structure of outermost layer of Latent electrostatic image support used in image-forming apparatuses | | | |
|---|---|---|---|---|---|
| | | Film thickness of Surface h2 μm | Diameter of Filler D2 μm | h2/D2 — | Content of Filler % by weight |
| Image-forming apparatus 1 | Example 1 | 6 | 0.6 | 10 | 18.2 |
| Image-forming apparatus 2 | Example 2 | 6 | 3 | 2 | 18.2 |
| Image-forming apparatus 3 | Example 3 | 6 | 0.1 | 60 | 18.2 |
| Image-forming apparatus 4 | Example 4 | 6 | 0.04 | 150 | 18.2 |
| Image-forming apparatus 5 | Example 5 | 6 | 0.6 | 10 | 3 |
| Image-forming apparatus 6 | Example 6 | 6 | 0.6 | 10 | 70 |
| Image-forming apparatus 7 | Example 7 | 6 | 0.3 | 10 | 35 |
| Image-forming apparatus 8 | Example 8 | 6 | 1.2 | 10 | 35 |
| Image-forming apparatus 9 | Example 9 | 6 | 0.6 | 10 | 35 |
| Image-forming apparatus 10 | Example 10 | 6 | 0.6 | 10 | 35 |
| Image-forming apparatus 11 | Comp. Ex. 1 | 6 | 0.1 | 10 | 35 |
| Image-forming apparatus 12 | Comp. Ex. 2 | 6 | 0.6 | 10 | 35 |
| Image-forming apparatus 13 | Comp. Ex. 3 | 6 | 2 | 10 | 35 |
| Image-forming apparatus 14 | Comp. Ex. 4 | 6 | 0.6 | 10 | 35 |

-continued

| | |
|---|---|
| Total number of test copies: | Until a problem appeared in the image or latent electrostatic image support (300000 sheets maximum) |
| Test of blurred image: | Examination of bleeding of character chart presence or absence of flow |
| Frequency of test of blurred image: | Three times a day, including the time when starting photocopy (the first thing to do in the morning), the time while the repeat photocopying test was carried out, and the time after the repeat photocopying tests. |
| Observation of latent electrostatic image support: | Change in appearance of latent electrostatic image support observed visually after completing the repeat photocopying tests of the day |

EXAMPLES 15–18

In Examples 15–18, an image-forming apparatus was manufactured in an identical way to that of Example 1, except that the alumina particles used for the carrier coating layer and the outermost layer of the latent electrostatic image support in the image-forming apparatus of Example 1, were replaced by titania (Example 15), silica (Example 16) and zinc oxide (Example 17). When these image-forming apparatuses were evaluated in the same way to that of Example 1, there was absolutely no image deformation in any of the image-forming apparatuses, and image quality was good from the beginning, over time.

The values of h1, D1 and D1/h1 of the carrier coating layer and the outermost layer of the latent electrostatic image support in Examples 15 to 18, are shown in Table 4 and Table 5.

TABLE 3

| | | Durability test results | |
|---|---|---|---|
| | | Image deformation | Abnormalities in durability test |
| Image-forming apparatus 1 | Example 1 | None at all, good | None at all, good |
| Image-forming apparatus 2 | Example 2 | None at all, good | Squamous image at half-tone part |
| Image-forming apparatus 3 | Example 3 | None at all, good | None at all, good |
| Image-forming apparatus 4 | Example 4 | None at all, good | Protecting layer partially worn out at 260,000th sheet, and filming occurred in the worn part |
| Image-forming apparatus 5 | Example 5 | None at all, good | Protecting layer partially worn out at the 210,000th sheet, and filming occurred in the worn part |
| Image-forming apparatus 6 | Example 6 | Blurred image found at the start after photocopying 200,000 sheets or more | None at all, good |
| Image-forming apparatus 7 | Example 7 | None at all, good | None at all, good |
| Image-forming apparatus 8 | Example 8 | Particles on a carrier coating layer separated after photocopying the 200,000 sheets or more, and blurred image found at the start | None at all, good |
| Image-forming apparatus 9 | Example 9 | None at all, good | Toner filming on carrier surface became obvious and density slightly declined at the 230,000th sheet |
| Image-forming apparatus 10 | Example 10 | Particles on a carrier coating layer separated after photocopying the 210,000 sheets or more, and blurred image found at the start | None at all, good |
| Image-forming apparatus 11 | Comp. Ex. 1 | Slight image deformation at photocopying only at the 10,000th sheet | Fewer test sheets, no particular remarks |
| Image-forming apparatus 12 | Comp. Ex. 2 | Serious image deformation found at 10,000th sheet | Fewer test sheets, no particular remarks |
| Image-forming apparatus 13 | Comp. Ex. 3 | Particles on carrier coating layer separated after photocopying 50,000 sheets or more, and blurred image found at the start | Toner filming on carrier surface became obvious and density slightly declined at the 100,000th sheet |
| Image-forming apparatus 14 | Comp. Ex. 4 | Particles on carrier coating layer separated after photocopying 50,000 sheets or more, and blurred image found at the start, | Toner filming on carrier surface became obvious and density slightly declined at the 100,000th sheet |

TABLE 4

| Structure of the Carrier coating layer | | | | |
|---|---|---|---|---|
| | Particle type | Film thickness of Resin (h1) μm | Particle diameter (D1) μm | D1/h1 |
| Example 15 | $TiO_2$ | 0.15 | 0.6 | 4 |
| Example 16 | $SiO_2$ | 0.15 | 0.6 | 4 |
| Example 17 | $SiO_2$ | 0.06 | 0.2 | 3.33 |
| Example 18 | $ZnO_2$ | 0.17 | 0.6 | 3.52 |

TABLE 5

| Structure of the outermost layer of the latent electrostatic image support | | | | |
|---|---|---|---|---|
| | Particle type | Resin thickness (h1) μm | Particle diameter (D1) μm | D1/h1 |
| Example 15 | $TiO_2$ | 6 | 0.6 | 10 |
| Example 16 | $SiO_2$ | 5.5 | 0.6 | 9.17 |
| Example 17 | $SiO_2$ | 4 | 0.2 | 20 |
| Example 18 | $ZnO_2$ | 6.2 | 0.6 | 10.33 |

EXAMPLE 19

An image-forming apparatus according to the present invention was constructed by incorporating the developer and the latent electrostatic image support manufactured in Example 1, into a tandem type color image-forming apparatus, using an elastic intermediate belt shown in FIG. 6.

As shown in FIG. 6, the tandem type high speed color image-forming apparatus accommodates a latent electrostatic image support 71 and four toner hoppers 78 holding a double-component developer in series. Using developers of different colors, toner images were sequentially disposed, superimposed and then transferred onto a recording medium, as a primary intermediate transfer belt 74 moves. A color image was formed on a medium, accordingly. The medium was transferred by a transfer roller 76 and a secondary intermediate transfer belt 75. A color image was finally fixed by a fixer 77.

When this image-forming apparatus was tested in an identical way to that of Example 1, good images were continuously obtained without any image deformation, despite the use of a high speed color image-forming apparatus.

According to the present invention, even when images are formed using a latent electrostatic image support comprising a filler in the outermost layer, image deformation of the formed image can be avoided. Further, according to the image-forming apparatus of the present invention, filming on the latent electrostatic image support surface can be prevented and good images can be obtained over a long period of time. At the same time, as filming on the carrier surface is also prevented, good images can be formed over a long period of time, if the image-forming apparatus of the present invention is used.

What is claimed is:

1. An image-forming apparatus comprising:

an image developer configured to develop a latent electrostatic image and to have:

a developer;

a developer bearing member which has a magnet therein, has the developer on a surface thereof, and rotates with carrying the developer; and a developer limiting member which faces the developer bearing member, and controls an amount of the developer; and a latent electrostatic image support configured to contain a filler in an outermost layer thereof, wherein the developer is a double-component developer which contains a magnetic carrier and a toner, the magnetic carrier has a coating layer which is formed of a binder resin having particles retained on a surface of the magnetic carrier, a ratio of a particle diameter D1 of the particles to a film thickness h1 of the binder resin satisfies a relation of: $1<D1/h1<10$, and wherein a ratio of a film thickness h2 of the outermost layer to a filler diameter D2 of the filler satisfies a relation of: $3<h2/D2<100$.

2. An image-forming apparatus according to claim 1, wherein a ratio of a film thickness h2 of the outermost layer to a filler diameter D2 of the filler satisfies a relation of: $3<h2/D2<7$.

3. An image-forming apparatus according to claim 1, wherein a ratio of a film thickness h2 of the outermost layer to a filler diameter D2 of the filler satisfies a relation of: $10<h2/D2<50$.

4. An image-forming apparatus according to claim 1, wherein a content of the particles in the coating layer is 50% by weight to 90% by weight.

5. An image-forming apparatus according to claim 1, wherein a content of the particles in the coating layer is 70% by weight to 90% by weight.

6. An image-forming apparatus according to claim 1, wherein the magnetic carrier has a core material, and the core material has an average particle diameter of 20 μm to 80 μm.

7. An image-forming apparatus according to claim 1, wherein a content of the filler in the outermost layer is 5% by weight to 60% by weight.

8. An image-forming apparatus according to claim 1, wherein a content of the filler in the outermost layer is 10% by weight to 40% by weight.

9. An image-forming apparatus according to claim 1, wherein the binder resin contains one of an acrylic resin and a guanamine resin.

10. An image-forming apparatus according to claim 1, wherein a layer of the binder resin has a thickness of 0.01 μm to 1 μm.

11. An image-forming apparatus according to claim 1, wherein the outermost layer has a thickness of 20 μm to 30 μm.

12. An image-forming apparatus according to claim 1, wherein the particles in the coating layer and the filler are selected from alumina, silica, titania, and zinc oxide.

13. An image-forming apparatus according to claim 1, further comprising:

one or more latent electrostatic image supports, wherein each of the latent electrostatic image supports has a monochromatic toner image, and the monochromatic toner image is sequentially disposed onto a medium from each of the latent electrostatic image supports, so as to form a color image.

14. An image-forming apparatus according to claim 1, further comprising:

an intermediate transfer on which monochromic toner images are primarily transferred from a plurality of latent electrostatic image supports and each of the monochromic toner images are sequentially disposed so as to form a color image, and the intermediate transfer configured to secondly transfer the color image onto a recording medium, at once.

15. An image-forming apparatus according to claim 14, wherein the intermediate transfer is a seamless belt, and one of whole and a portion of a layer of the seamless belt is an elastic belt formed of an elastic material.

16. An image-forming process-cartridge comprising:

an image developer configured to develop a latent electrostatic image and to have:

a developer;

a developer bearing member which has a magnet therein, has the developer on a surface thereof, and rotates with carrying the developer; and a developer limiting member which faces the developer bearing member, and controls an amount of the developer; and a latent electrostatic image support configured to contain a filler in an outermost layer thereof, wherein the process cartridge is formed in a one-piece construction and is attachable to and detachable from an image-forming apparatus, the developer is a double-component developer which contains a magnetic carrier and a toner, the magnetic carrier has a coating layer which is formed of a binder resin having particles retained on a surface of the magnetic carrier, a ratio of a particle diameter D1 of the particles to a film thickness h1 of the binder resin satisfies a relation of: $1<D1/h1<10$, and wherein a ratio of a film thickness h2 of the outermost layer to a filler diameter D2 of the filler satisfies a relation of: $3<h2/D2<100$.

* * * * *